US005447126A

United States Patent [19]

Kondoh et al.

[11] Patent Number: 5,447,126

[45] Date of Patent: Sep. 5, 1995

[54] VARIABE CAM PHASER FOR INTERNAL COMBUSTION ENGINE

[75] Inventors: Takehisa Kondoh; Akio Akasaka; Seiji Suga; Noboru Egashira; Hiroaki Imai, all of Atsugi, Japan

[73] Assignee: Unisia Jecs Corporation, Atsugi, Japan

[21] Appl. No.: 343,992

[22] Filed: Nov. 18, 1994

[30] Foreign Application Priority Data

| | | | |
|---|---|---|---|
| Nov. 18, 1993 | [JP] | Japan | 5-288563 |
| Feb. 28, 1994 | [JP] | Japan | 6-029885 |
| Feb. 28, 1994 | [JP] | Japan | 6-029886 |
| Feb. 28, 1994 | [JP] | Japan | 6-029887 |
| Feb. 28, 1994 | [JP] | Japan | 6-029888 |
| Feb. 28, 1994 | [JP] | Japan | 6-029889 |
| Feb. 28, 1994 | [JP] | Japan | 6-029890 |
| Feb. 28, 1994 | [JP] | Japan | 6-029911 |

[51] Int. Cl.[6] ..... F01L 1/34

[52] U.S. Cl. ..... 123/90.17; 123/90.31; 74/568 R; 464/2; 464/160

[58] Field of Search ..... 123/90.12, 90.15, 90.17, 123/90.31; 74/567, 568 R; 464/1, 2, 160

[56] References Cited

U.S. PATENT DOCUMENTS

| | | | |
|---|---|---|---|
| 2,986,125 | 5/1961 | Young et al. . | |
| 4,627,825 | 12/1986 | Bruss et al. | 464/2 |
| 5,088,456 | 2/1992 | Suga | 123/90.17 |
| 5,113,814 | 5/1992 | Suga et al. | 13/90.17 |
| 5,144,921 | 9/1992 | Clos et al. | 123/90.17 |
| 5,197,421 | 3/1993 | Hara | 123/90.17 |
| 5,201,289 | 4/1993 | Imai | 123/90.17 |
| 5,263,442 | 11/1993 | Hara | 123/90.17 |
| 5,301,639 | 4/1994 | Satou | 123/90.17 |
| 5,309,873 | 5/1994 | Suga et al. | 123/90.17 |

FOREIGN PATENT DOCUMENTS

| | | |
|---|---|---|
| 0317372 | 5/1989 | European Pat. Off. . |
| 422791 | 4/1991 | European Pat. Off. . |
| 0492557 | 7/1992 | European Pat. Off. . |
| 3619956 | 12/1987 | Germany . |
| 353447 | 1/1989 | Japan . |
| 19454 | of 1911 | United Kingdom . |
| 2228780 | 9/1990 | United Kingdom . |

*Primary Examiner*—Henry C. Yuen
*Assistant Examiner*—Weilun Lo
*Attorney, Agent, or Firm*—Foley & Lardner

[57] ABSTRACT

A variable cam phaser (VCP) is disclosed in various modifications. The VCP includes a piston responsive to pressure in a fluid chamber having an inlet orifice and a plurality of outlets including a first outlet and a plurality of second outlets. A valve slide is movable to cover said second outlets one after another to pressurize the fluid chamber to displace the piston against a return spring. Outer and inner splined slides are drivingly mated with an internal helical spline of a cylindrical body secured to a sprocket and an external helical spline of a stub shaft secured to a camshaft. The splined slides are disposed between the piston and the return spring. Thus, movement of the piston and splined slides assembly in response to pressurization or depressurization of the fluid chamber advances or retards the valve timing or phase angle of the camshaft relative to the sprocket.

17 Claims, 25 Drawing Sheets

VARIABE CAM PHASER FOR INTERNAL COMBUSTION ENGINE

BACKGROUND OF THE INVENTION

The present invention relates to a variable cam phaser for an internal combustion engine.

JP 3-53447 B2 discloses a variable cam phaser for the angular adjustment of a camshaft with respect to a drive wheel. By means of this variable cam phaser, the angular adjustment is effected by an annular piston. The annular piston has inner and outer splines of varying lead. The annular piston is slidably mounted in a hydraulic cylinder and defines in the hydraulic cylinder a fluid chamber. The piston is biased by a return spring. The annular piston is axially movable. This movement of the annular piston in the cylinder causes the drive and driven members to undergo relative angular displacement in a direction corresponding to the direction of movement of the annular piston. The cam phaser further includes valve means for pressurizing the fluid chamber for displacing the annular piston in one direction against the return spring or depressurizing said fluid chamber for allowing said return spring to displace the annular piston in the opposite direction and thereby controlling the relative angular position of the drive and driven members. The annular piston is subject to the bias of the return spring via a control sleeve so that the control sleeve follows the axial movement of the annular piston. The control sleeve has an axial bore which constitutes an inlet or an outlet always open to the fluid chamber. The control sleeve has an inner peripheral wall formed with an inner circumferential groove communicating with the axial bore. The inner peripheral wall of the control sleeve defines a space communicating with a drainage. The driven member has an inner circumferential transfer groove and bores connecting the transfer groove to a source of fluid pressure. The transfer groove is wide enough to maintain fluid flow communication with a radial bore extending through the control sleeve during axial movement of the annular piston. This radial bore terminates in a port, namely, a supply port, with which the inner peripheral wall of the control sleeve is formed. The valve means includes a spool slidably mounted in the control sleeve. The spool has a circumferential groove adjacent a land. The circumferential groove of the spool is kept in communication with the supply port to receive fluid pressure, while the land covers the inner circumferential groove of the control sleeve. Shifting the spool in one direction causes the land to uncovers the inner circumferential groove of the control sleeve to communicate with the supply port of the control sleeve via the circumferential groove of the spool, pressurizing the fluid chamber and thereby displacing the annular piston and the control sleeve against the return spring. This displacement continues until the inner circumferential groove of the control sleeve is covered by the land of the spool again. Subsequently, shifting the spool in the opposite direction causes the land to uncover the inner circumferential groove to communicate with the drain space, depressurizing the fluid chamber and thereby allowing the return spring to displace the annular piston and the control sleeve in the opposute direction until the inner circumferential groove of the control sleeve is covered again. In this manner the annular piston can take any position corresponding to a position taken by the spool.

An object of the present invention is to provide an alternative to the variable cam phaser of the above kind.

SUMMARY OF THE INVENTION

According to the present invention, there is provided a variable cam phaser comprising drive and driven members, coupling means for drivingly connecting said drive and driven members in driving relation, said coupling means including means for enabling said drive and driven members to be relatively angularly adjustable while maintaining the driving relation therebetween, said enabling means including a hydraulic cylinder, a piston slidably mounted for movement in said hydraulic cylinder, said piston defining in said cylinder a fluid chamber, and a return spring biasing said piston toward said fluid chamber, the movement of said piston in said cylinder causing said drive and driven members to undergo relative angular displacement in a direction corresponding to the direction of movement of said piston, and valve means for pressurizing said fluid chamber for displacing said piston in one direction against said return spring and depressurizing said fluid chamber for allowing said return spring to displace said piston in the opposite direction and thereby controlling the relative angular position of said drive and driven members, wherein there are provided an inlet which is always open to said fluid chamber and a plurality of outlets for venting said cylinder, said plurality of outlets including a first outlet which is always open to said fluid chamber and at least one second outlet for venting said hydraulic cylinder, said valve means has a first end position wherein said first outlet is vented to depressurize said fluid chamber, allowing said piston to take one extreme position thereof under the bias of said return spring, said piston in said one extreme position thereof blocking flow communication between said fluid chamber and said second outlet, said valve means has a second end position wherein said first and second outlets are closed to pressurize said fluid chamber, displacing said piston against said return spring to the opposite extreme position thereof, said piston in said the opposite extreme position thereof opening flow communication between said fluid chamber and said second outlet, said valve means has an intermediate position wherein said first outlet is closed and said second outlet is vented, moving said valve means from said first end position thereof to said intermediate position thereof pressurizes said fluid chamber, displacing said piston against said return spring until said piston regulates discharge of hydraulic fluid from said fluid chamber through said second outlet to establish an equilibrium state wherein pressure within said fluid chamber balances with said return spring, moving said valve means from said second end position thereof to said intermediate position thereof depressurizes said fluid chamber, allowing said return spring to displace said piston until said pistion regulates discharge of hydraulic fluid from said fluid chamber through said second outlet to establish said equilibrium state.

DETAILED DESCRIPTION OF THE INVENTION

Figure 1:
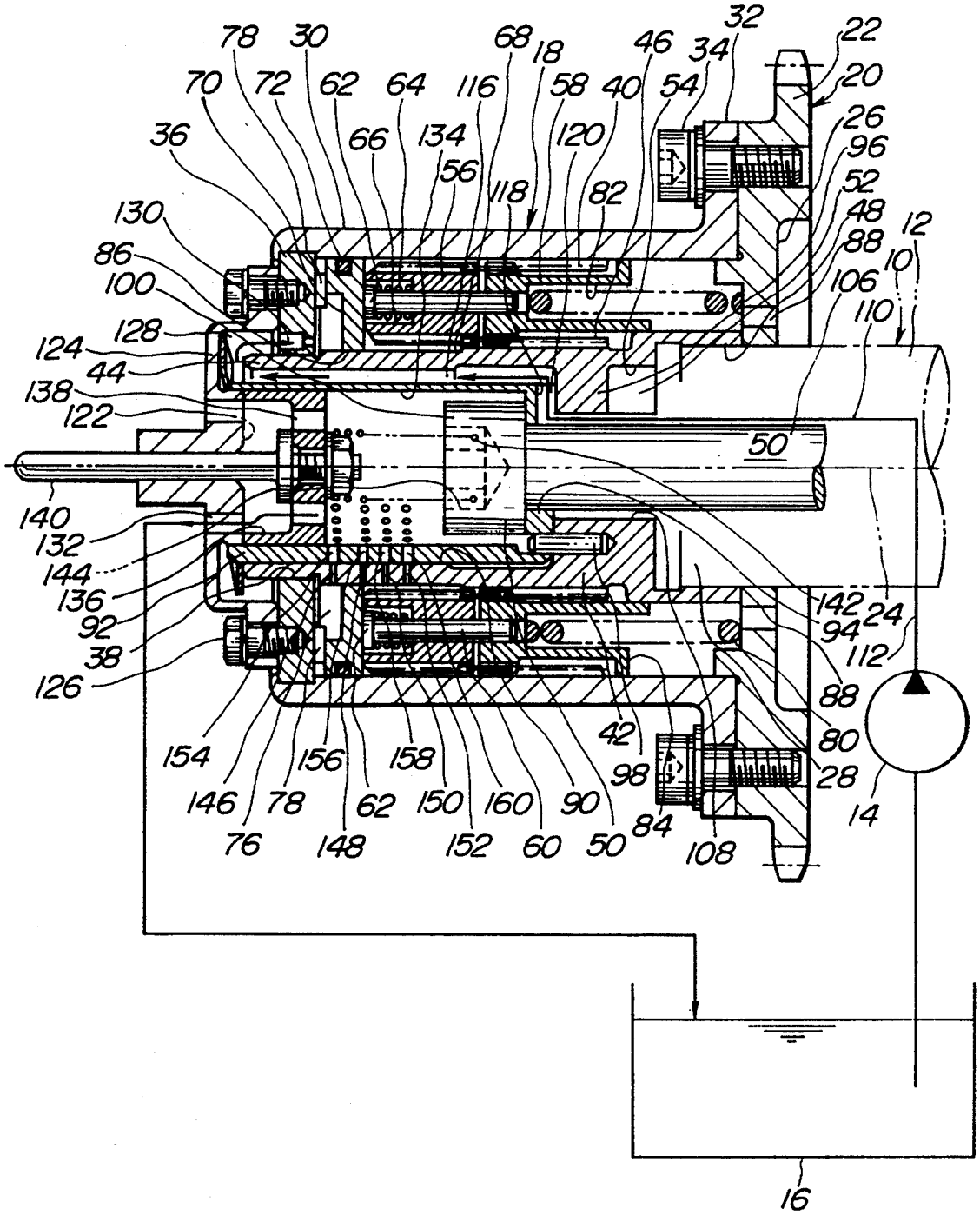
FIG. 1 is a logitudinal section of a first embodiment of a variable cam phaser according to the present invention, the variable cam phaser having a valve in a first end position thereof.

Referring to FIG. 1, the reference numeral 10 generally indicates an internal combustion engine of a type having a camshaft 12 driven by a crankshaft, not shown. The camshaft 12, shown in phantom line, carries a plurality of cams (not shown) for actuating cylinder valves (not shown) of the engine in known manner. In this embodiment, the cylinder valves are intake valves although they may be exhaust valves. The camshaft 12 is supported by a bearing bracket, not shown, that is carried by the engine cylinder in known manner. The reference numeral 14 indicates an oil pump directly driven by the crankshaft. The reference numeral 16 indicates an oil pan.

On the front, driven, end of the camshaft 12, there is a phaser adjuster or variable cam phaser (VCP) 18 that includes a sprocket 20. The sprocket 20 comprises a drive member with a peripheral drive portion, i.e., wheel 22, that is toothed and drivingly engaged by a chain, not shown, for rotatably driving the sprocket 20 about an axis 24that is co-axial with the camshaft 12. Within the wheel 22 is a radially extending hub 26. The rear hub 26 abuts on a front part 28 of the camshaft 12. This part 28 of the camshaft 12 forms a journal shaft and a centering pin for the wheel 22. A cylindrical body 30 has at a rear end a flange 32 secured to the radially extending 26 by a plurality of bolts 34 and extending forwardly from the radially extending hub 26. The cylindrical body 30 has at a front end thereof a cover 36. The cover 36 has a peripheral edge fixedly retained by the cylindrical body 30. The cover 36 has a central opening 38. The cylindrical body 30 has an internal helical spline 40.

The VCP 18 further includes a stub shaft 42 (see also FIG. 2) having at one end a reduced diameter journal 44 extending through the central opening and rotatably supported supported the cover 36. The stub shaft 42 further includes an external helical spline 46 adjacent the other end. This end is secured through a central opening 48 to the front end of the camshaft 12 by a bolt 50 with a key projection 52 extending from the front end of the camshaft 12 received in a groove 54 of the stub shaft 42 to maintain a fixed drive relationship between the stub shaft 42 and the camshaft 12.

The facing splines 40 and 46 have opposite and, preferrably equal leads (or helix angles) to provide for phasing action. Between and engagingboth splines 40 and 46 are two axially-spaced annular slides, called for convenience, an outer slide 56 and an inner slide 56, the latter being closer to the radially extending sprocket hub 26. Both slides 56 and 58 have inner and outer helical splines drivingly mated with the splines 46 and 40 of the sub shaft 42 and cylindrical body 30, respectively.

The splines are mis-aligned so that, when the slides 56 and 58 are urged inwardly towards one another, they engage opposite sides of the mated splines 46 and 40 and thus take up the lash that would otherwise occur in transferring drive torque between the sprocket 20 and stub shaft 42. The slides 56 and 58 are urged, i.e., biased, towards one another by angularly spaced pins 60 press-fitted in the inner slide 58 and having heads 62 compressing springs 64 in recesses 66 on the far side of the outer slides 56.

Figure 4:
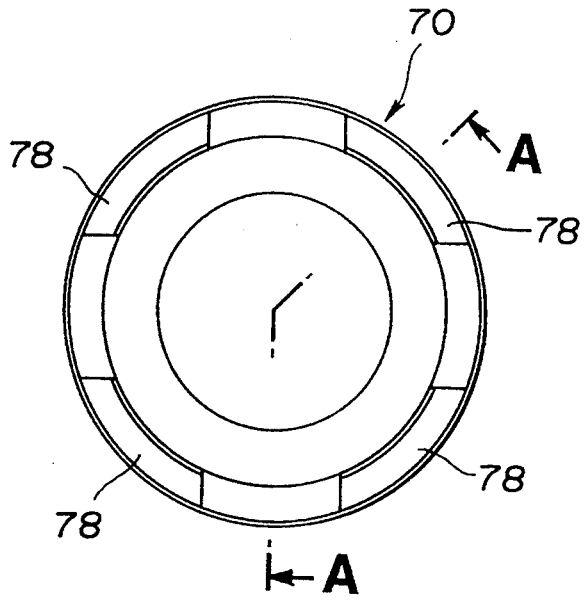
FIG. 4 is an axial end elevation of a piston.
Figure 5:
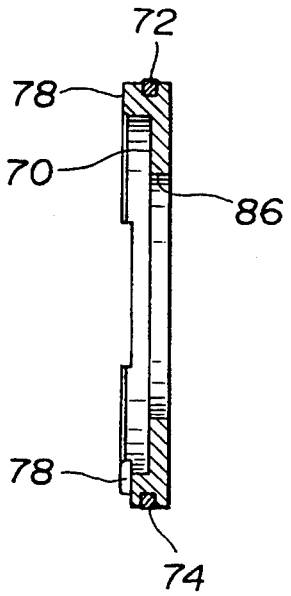
FIG. 5 is a section taken through the line A—A of FIG. 4.

An annular cylinder 68 is defined between the outer cylindrical body 30 and stub shaft 42. The annular cylinder 68 has one end closed and the opposte end disposed adjacent the splines 46 and 40. An annular piston 70 (see FIGS. 4 and 5) is slidably disposed in the cylinder 68 and between the outside face of the outer slide 56 and the cover 36. An oil seal 72 is received in a circumferential groove 74 of the piston 70 (see also FIG. 5). Owing to this oil seal 72, the piston 70 together with the adjacent walls of the cylindrical body 30 and stub shaft 42 and the adjacent wall of the cover 36 define an annular chamber 76 within the cylinder 68. As readily seen from FIGS. 4 and 5, the annular piston 70 has near the outer periphery thereof four equi-angularly spaced seats 78 adapted to abut the adjacent wall of the cover 36.

The annular piston 70 and slides 56, 58 assembly is urged in a direction compressing the annular chamber 76 by a coil return spring 80 that extends between an end of a recess 82 in the inner slide 58 and an inner face of the sprocket radially extending hub 26.

Referring back to FIG. 1, the inner slide 58 has at one end splined and at the other end a radially extending circumferential protrusion 84 slidably engaging the adjacent inner wall of the cylindrical body 30. This protrusion 84 serves as a guide to ensure smooth axial movement of the piston 70 and slides 56, 58 assembly. Smooth axial movement of the piston and slides assembly is effective to reduce oil leak path through a clearance between the outer wall of the stub shaft 42 and the inner peripheral wall 86 of the annular piston 70. However, there exist oil leak paths through the valleys of the splines of the outer and inner slides 56 and 58 and the mating external and internal splines 46 and 40. In order to discharge oil having past through the leak paths, the sprocket radially extending hub 26 has drain holes 88.

Figure 3:
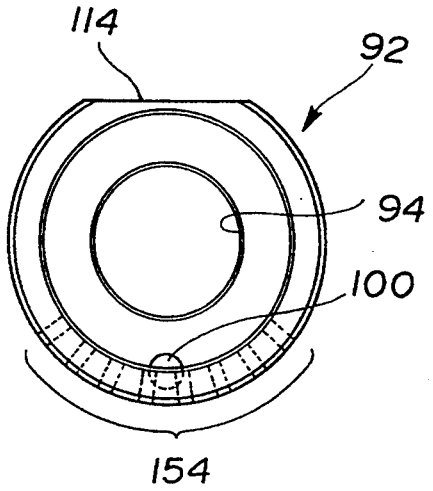
FIG. 3 is an axial end elevation of a bushing adapted to be secured to the camshaft together with the shaft of FIG. 2 for unitary rotation therewith.

The stub shaft 42 has a bore 90 receiving a cylindrical bushing 92 (see also FIG. 3). The bushing 92 has one end closed. The closed end of the bushing 92 is secured through a central opening 94 to a front face of a radially extending hub 96 of the stub shaft 42 by the bolt 50 with a dowel pin 98 received in openings 100 and 102 of the bushing 92 and stub shaft 42 to maintain a fixed drive relation between the stub shaft 42 and bushing 92. The bolt 50 has a head 104 and a shank 106 extending through a central opening 108 defined by the radially extending hub 96 of the stub shaft 42 with an annular clearance between the shank 106 and the radially extending hub 96. This annular clearance is connected through a schematically illustrated passage 110 with an oil gallery 112. As readilly seen from FIGS. 1 and 3, the bushing 92 is recessed at 114 over the whole axial dimension of thereof to define together with the adjacent cylindrical wall of the bore 90 an axially extending passage 116. The closed end of the bushing 92 has a face in firm engagement with the adjacent wall of the radially extending hub 96 of the stub shaft 42 and a radial groove 118 recessed from this face. The radial groove 118 extends from the central opening 94 to the recessed portion 114. A radial passage 120 is formed by this radial groove 118 and connects the axial passage 116 with the annular clearance around the shank 106 of the bolt 50. The outer open end of the cylindrical bushing 92 is rotatably supported by a central boss 122 of an end plug 124 which is secured to the cover 36 by fasteners 126. The end plug 124 has an annular groove 128 with which the outwre end of the axial passage 116 communicates. The cover 36 has a bore 130 which constitutes an inlet orifice to the annular cylinder 68 and which is always open to the annular chamber 76. This bore 130 is open to the annular bore 128.

Figure 7:
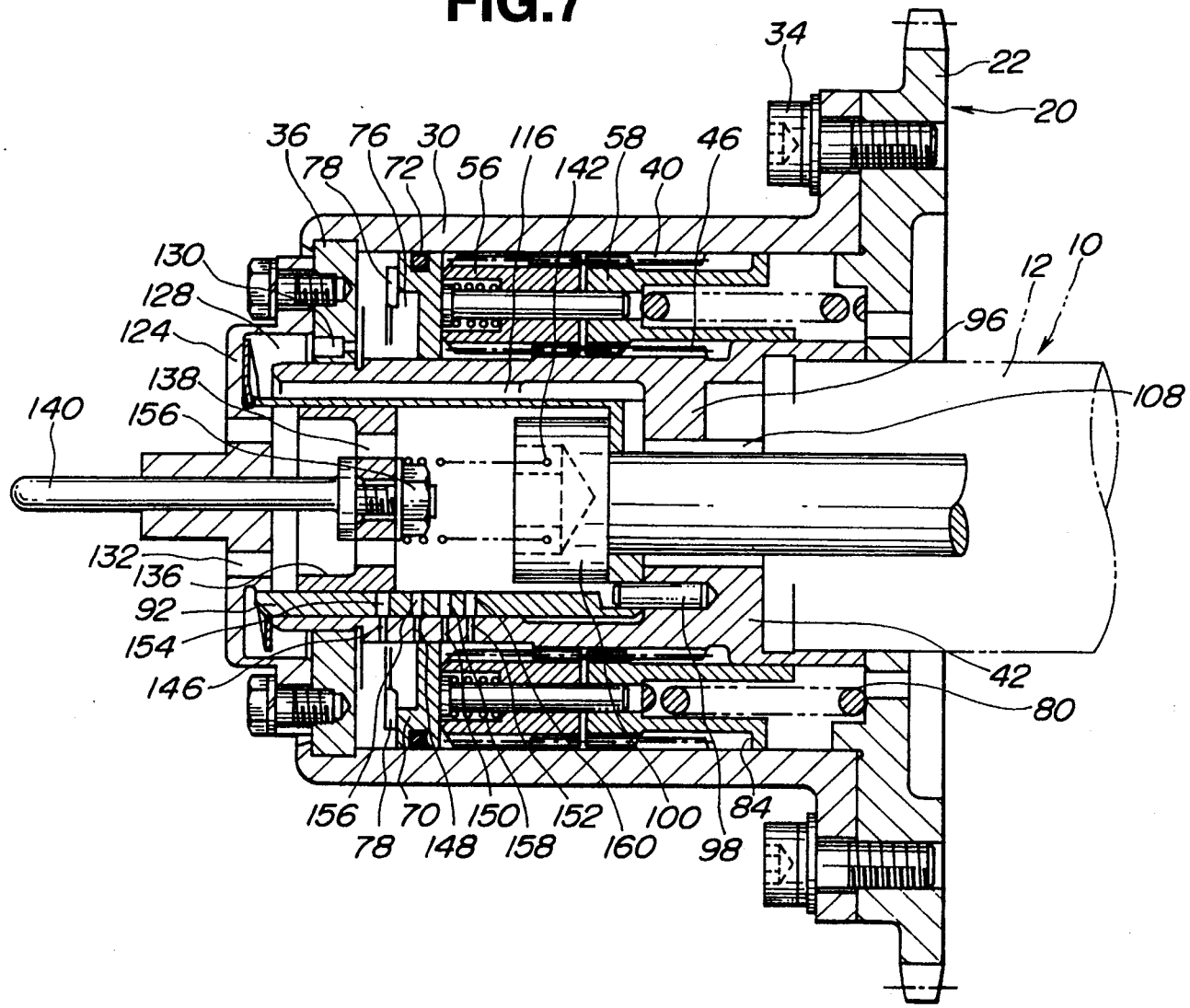
FIG. 7 is a similar view to FIG. 1 showing position of parts when the valve is in a first intermediate position.
Figure 8:
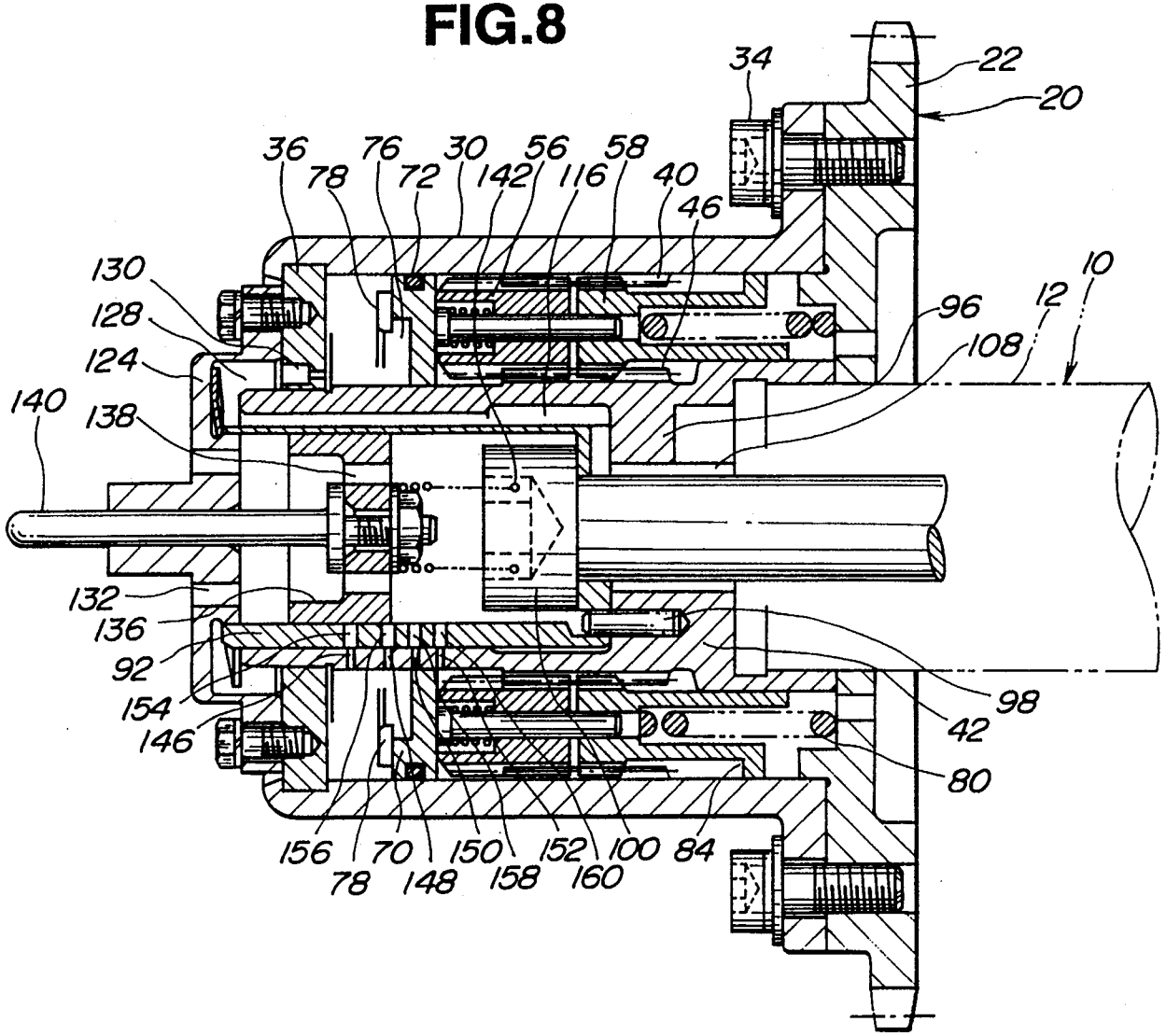
FIG. 8 is a similar view to FIG. 1 showing position of parts when the valve is in a second intermediate position thereof.
Figure 9:
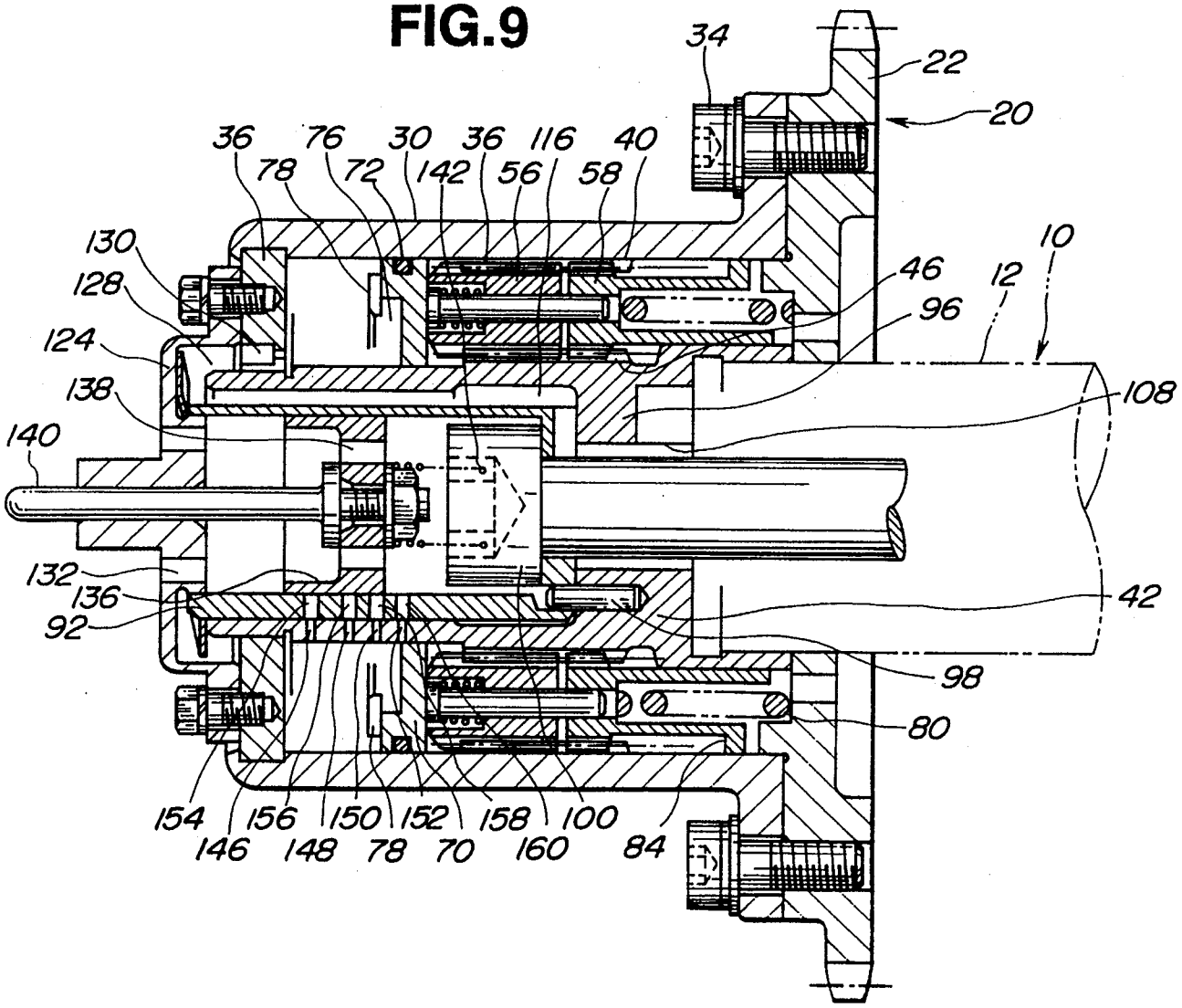
FIG. 9 is a similar view to FIG. 1 showing position of parts when the valve in in a third intermediate position thereof.
Figure 10:
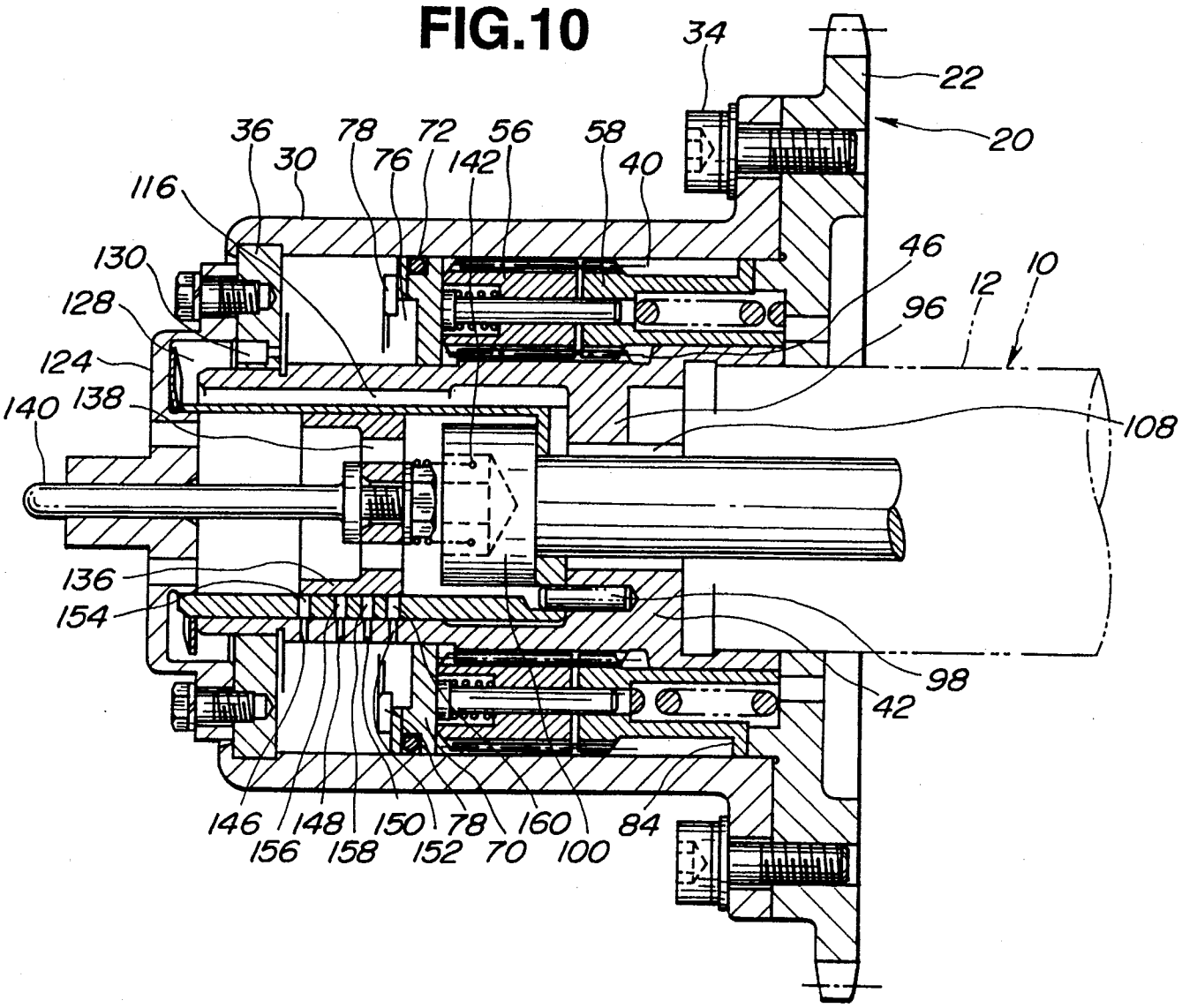
FIG. 10 is a similar view to FIG. 1 showing position of parts when the valve is in a second end position thereof.

The end plug 124 has drain holes 132 for discharging oil from a cylindrical bore 134 defined by the bushing 92. A valve in the form of a slide 136 is slidably mounted within the bushing 92 and has axial through passages 138 for allowing free flow paths therethrough. The slide 136 is secured to a rod 140 which extends forwardly and outwardly through the end plug 124. The slide 136 is biased in a direction toward the end plug 124 by a return spring 142 that extends between the slide 136 and a recess 144 of the head 104 of the bolt 50. The rod 140 is drivingly connected to an actuator including a stepper motor, not shown, to urge the rod 140 to move the slide 136 from a first end position as illustrated in FIG. 1 to a second end position as illustrated in FIG. 10 and vice versa. Further, the rod 140 can move the slide 136 to any one of three intermediate positions, namely a first intermediate position as illustrated in FIG. 7, a second intermediate position as illustrated in FIG. 8 and a third intermediate position as illustrated in FIG. 9.

Figure 2:
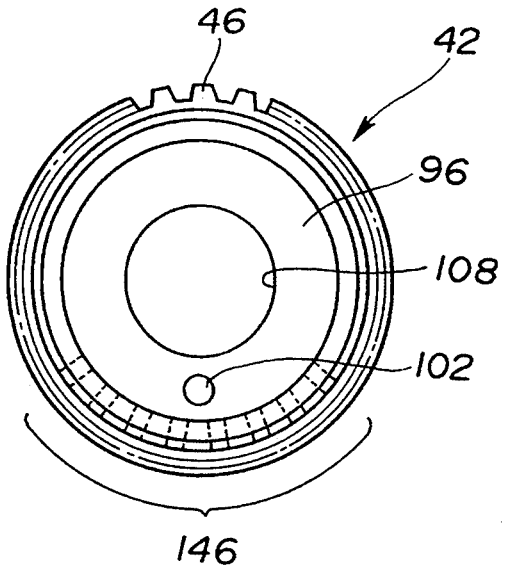
FIG. 2 is an axial end evelation of a shaft adapted to be secured to a camshaft for unitary rotation therewith.
Figure 6:
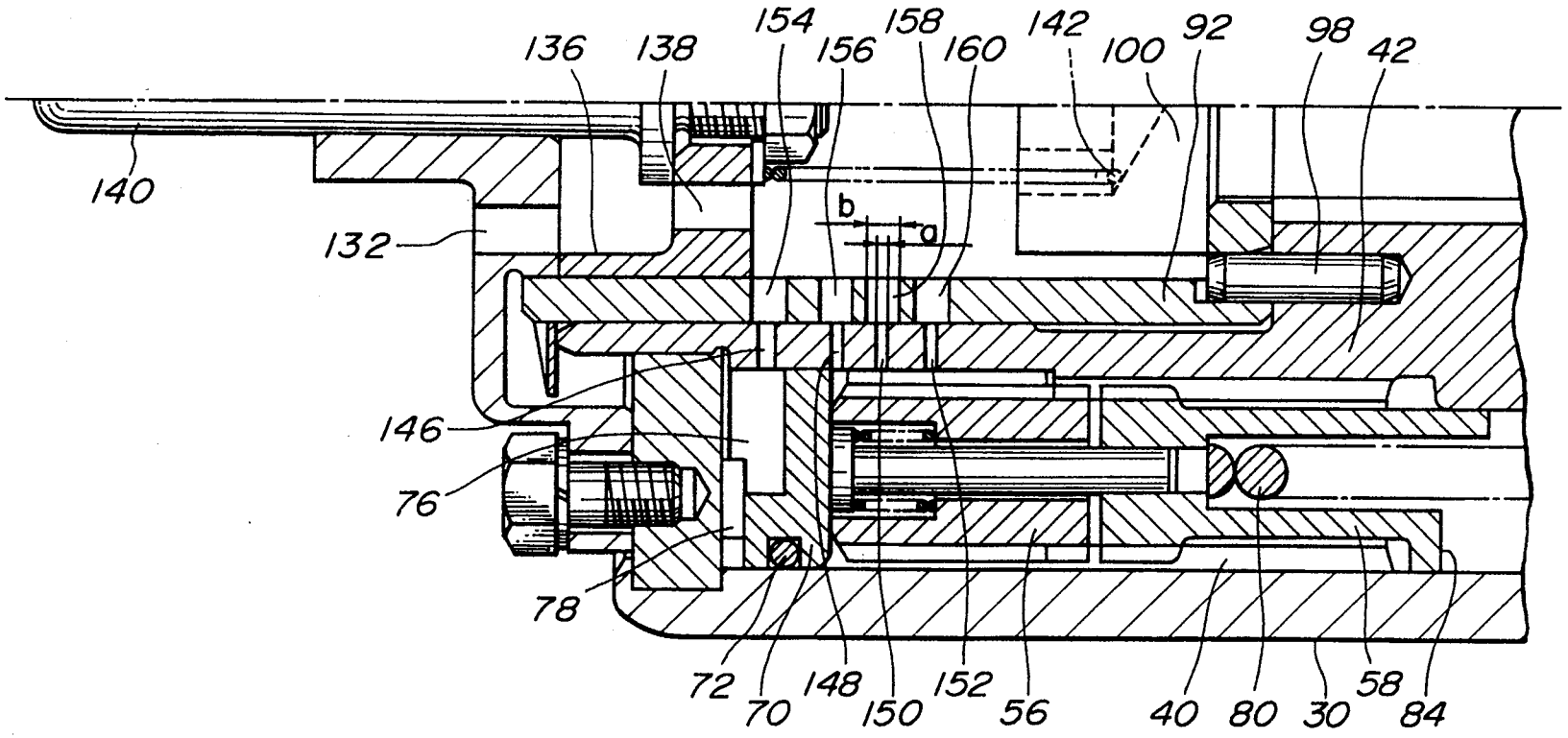
FIG. 6 is a fragementary enlarged view showing a portion of the bottom half of FIG. 1.

Referring to FIGS. 1, 2 and 6, the stub shaft 42 has four outlets 146, 148, 150 and 152 axially spaced one after another for venting the cylinder 68. Each outlet is constituted by eight circumferentially spaced bores (see FIG. 2). Similarly, the bushing 32 has four valve ports 154, 156, 158 and 160 axially spaced one after another. Each valve port is constituted by eight circumferentially spaced openings (see FIG. 3). The four outlets 154, 156, 158 and 160 are aligned with the corresponding valve ports 154, 156, 158 and 160, respectively. In other words, the eight circumferentially spaced bores of each outlet are aligned with the eight circumferentially spaced valve openings of the corresponding one of the valve ports.

Figure 11:
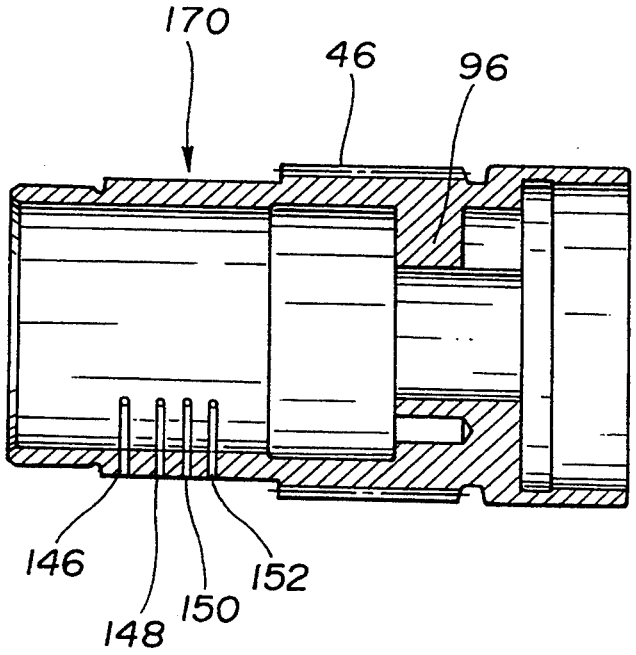
FIG. 11 is an axial section of an altermative form to the shaft used in FIG. 1.

Alternatively, each outlet may be constituted by a circumferentially extending slit as shown in FIG. 11. FIG. 11 shows a modified stub shaft 170 which is substantially the same as the sub shaft 42 except the fact that each of four outlets 146, 148, 150 and 152 is constituted by a circumferentially extending slit. In this case, each of the corresponding valve ports 154, 156, 158 and 160 is constituted by a circumferentially extending slit.

In operation of the VCP 18, when the slide 136 is in the first end position as illustrated in FIG. 1, the slide 136 uncovers and thus open all of the valve ports 154, 156, 158 and 160 to the cylindrical bore 134, thereby venting not only the outlet 146 which is always open to the annular chamber 76, but also the other three outlets 148, 150 and 152, thereby to depressurize the annular chamber 76. The return spring 80 is thus able to maintain the piston 70 and slides 56, 58 assembly to ist extreme outer position against the cover 36 whereby the volume of the annular chamber 76 is held at a minimum. In this position, the camshaft 12 is maintained by the slides 56, 58 in a retarded phase relation with the sprocket 20 for operation of the actuated engine intake valves under desired retarded timing conditions. In this position, oil supplied to the annular chamber 76 via the inlet orifice 130 is discharged through the outlet 146 and valve port 154 to the cylindrical bore 134 and through axial passages 138 of the slide 136 and drain holes 132 of the end plug 124 to the outside of the VCP 18. The oil discharged from the end plug 124 returns to the oil pan 16. It is seen from FIG. 1 that fluid communication between the other outlets 148, 150 and 152 and annular chamber 76 is blocked by the piston 70.

When the engine operating conditions call for fully advanced vaslve timing, the rod 140 is urged to move the slide 136 against the return spring 142 from the first end position to the second end position as illustrated in FIG. 10. In this position, the slide 136 covers all of the valve ports to close all of the outlets 146, 148, 150 and 152, thereby pressurizing the annular chamber 76 and displacing the piston 70 and slides 56, 58 assembly against the return spring 80 to the extreme inner position against the sprocket radially extending hub 26. Because of the opposite lead of the internal and external splines 40 and 46, the inward motion of the piston 70 and slides 56, 58 assembly advances the timing or phase angle of the camshaft 12 relative to the sprocket 20 so that the timing of the associated engine cylinder valves is likewise advanced. In this position, there is no discharge of oil from the annular chamber 76.

A return to the retarded timing when called for is accomplished by moving the slide 136 back to the first end position as illustrated in FIG. 1. The spring 80 then returns the piston 70 and slides 56, 58 assembly to its initial retarded position (see FIG. 1) adjacent the cover 36.

In addition to this phase-changing function, the slides 56, 58 are also the means through which all torque is transferred from the sprocket to the camshaft 12 and vice versa via their helical splines and the mating splines 40 and 46.

When the engine operating conditions call for less retarded valve timing, the rod 140 is urged to move the slide 136 to a desired one of three intermediate positions as illustrated in FIGS. 7, 8 and 9 against the return spring 80.

Let us now consider the case when the rod 140 is urged to move the slide 136 from the first end position (see FIG. 1) to the first intermediate position (see FIG. 7). In this position, the slide 136 covers the valve port 154 and thus closes the outlet 146, thereby pressurizing the annular chamber 76 and displacing the piston 70 and slides 56, 58 assembly against the spring 80. This movement of the piston 70 uncovers the outlet 148 communicating with the valve port 156 that is left open to the cylidrical bore 134, allowing discharge of oil through this outlet 148 and causing a drop of pressure within the annular chamber 76. The opening degree of the outlet 148 is controlled by the front edge of the inner peripheral wall of the annular piston 70. If this drop of pressure causes an excessive reduction of pressure within the annular chamber 76, the return spring 80 returns the piston 70 to reduce the opening degree of the outlet 148. In this manner, the piston 70 regulates discharge flow of oil through the outlet 148 to develop a pressure within the anular chamber 76 which is high enough to balance with the return spring 80. If this state is accomplished, the front edge of the inner peripheral wall of the annular piston 70 takes a position falling in a narrow window limited by leading and trailing edges of the outlet 148. The distance between the leading and trailing edges is the axial dimension or diameter of the outlet 148. In this position as illustrated in FIG. 7, the discharged oil from the annular chamber 76 passes through the outlet 148 and valve port 156 into the cylindrical bore 134.

Let us consider the case when the rod 140 is urged to move the slide 136 from the intermediate position just described above to another intermediate position as illustrated in FIG. 8. In this position, the slide 136 covers the valve port 156 in addition to the valve port 154 and thus closes the outlet 148 in addition to the outlet 146, thereby pressurizing the annular chamber 76 and displacing the piston 70 and slides 56, 58 assembly further against the spring 80. This further movement of the piston 70 uncovers the outlet 150 communicating with the valve port 158 that is left open to the cylindrical bore 134, allowing discharge of oil through this outlet 150 and causing a drop of pressure within the annular chamber 76. In the same manner as described, the piston 70 regulates discharge flow of oil through the outlet 150 to develop a pressure within the anular chamber 76 which is high enough to balance with the return spring 80. If this equilibrium state is accomplished, the front edge of the inner peripheral wall of the annular piston 70 takes a position falling in a narrow window limited by leading and trailing edges of the outlet 150. In this position as illustrated in FIG. 8, the discharged oil from the annular chamber 76 passes through the outlet 150 and valve port 158 into the cylindrical bore 134.

Let us consider the case when the rod 140 is urged to move the slide 136 from the intermediate position as illustrated in FIG. 8 to still another intermediate position as illustrated in FIG. 9. In this position, the slide 136 covers the valve port 158 in addition to the valve ports 154 and 156 and thus closes the outlet 150 in addition to the outlets 146 and 148, thereby pressurizing the annular chamber 76 and displacing the piston 70 and slides 56, 58 assembly further against the spring 80. This further movement of the piston 70 uncovers the outlet 152 communicating with the valve port 160 that is left open to the cylindrical bore 134, allowing discharge of oil through this outlet 152 and causing a drop of pressure within the annular chamber 76. In the same manner as described, the piston 70 regulates discharge flow of oil through the outlet 152 to develop a pressure within the anular chamber 76 which is high enough to balance with the return spring 80. If this equilibrium state is accomplished, the front edge of the inner peripheral wall of the annular piston 70 takes a position falling in a narrow window limited by leading and trailing edges of the outlet 152. In this position as illustrated in FIG. 9, the discharged oil from the annular chamber 76 passes through the outlet 152 and valve port 160 into the cylindrical bore 134.

Let us consider the case when the rod 140 is urged to move the slide 136 from the intermediate position as illustrated in FIG. 9 to the second end position as illustrated in FIG. 10. In this position, the slide 136 covers all of the valve port 154, 156, 158 and 160 and thus closes all of the outlets 154, 156, 158 and 160, thereby pressurizing the annular chamber 76 to a maximum and displacing the piston 70 and slides 56, 58 assembly against the spring 80. This further movement of the piston 70 fully uncovers the outlet 152 communicating with the valve port 160. This valve port 160 is covered by the slide 136. In this position as illustrated in FIG. 10, there is no discharge of oil from the annular chamber 76.

In the above described manner, the timing or phase angle of the camshaft 12 relative to the sprocket 20 can be varied in a descrete manner between the most advanced condition as illustrated in FIG. 10 and the most retarded condition as illustrated in FIG. 1.

A return to retarded timing as represented by one of intermediate positions as illustrated in FIGS. 7, 8 and 9 is accomplished by moving the slide 136 toward the cover 36 to the desired intermediate position. This movement of the slide 136 allows discharge of oil from the annular chamber 76 to depressurize same, allowing the spring 80 returns the piston 70 and slides 56, 58 assembly until the equilibrium state between the pressure of the annular chamber 76 and spring 80 is established.

Referring to FIG. 6, the preferred relation between the outlets 148, 150 and 152 and their associated vaslve ports 156, 158 and 160 is explained. As explained before, the distance a of each of these outlets 148, 150 and 152 between the leading and trailing edges thereof determines the width of the narrow window within which the front edge of the inner peripheral wall of the annular piston 70 moves to hold the equilibrimum state. In order to narrow the window, it is preferrable to set the distance or diameter a of each of the outlets 148, 150 and 152 smaller than the corresponding distance or diameter b of the associated valve ports 156, 158 and 160.

As shown in slightly exaggerated manner in FIG. 6, the size of the outlet 146 which is always open to the annular chamber 76 is larger than the size of each of the other outlets 148, 150 and 152. The size of the outlet 146 is determined to ensure enough discharge of oil from the annular chamber 76 to hold the pressure of the annular chamber sufficiently below a pressure level that balances with the return spring 80, thereby to hold the piston 90 and slides 56, 58 assembly in the position as illustrated in FIGS. 10 or 6.

Figure 12:
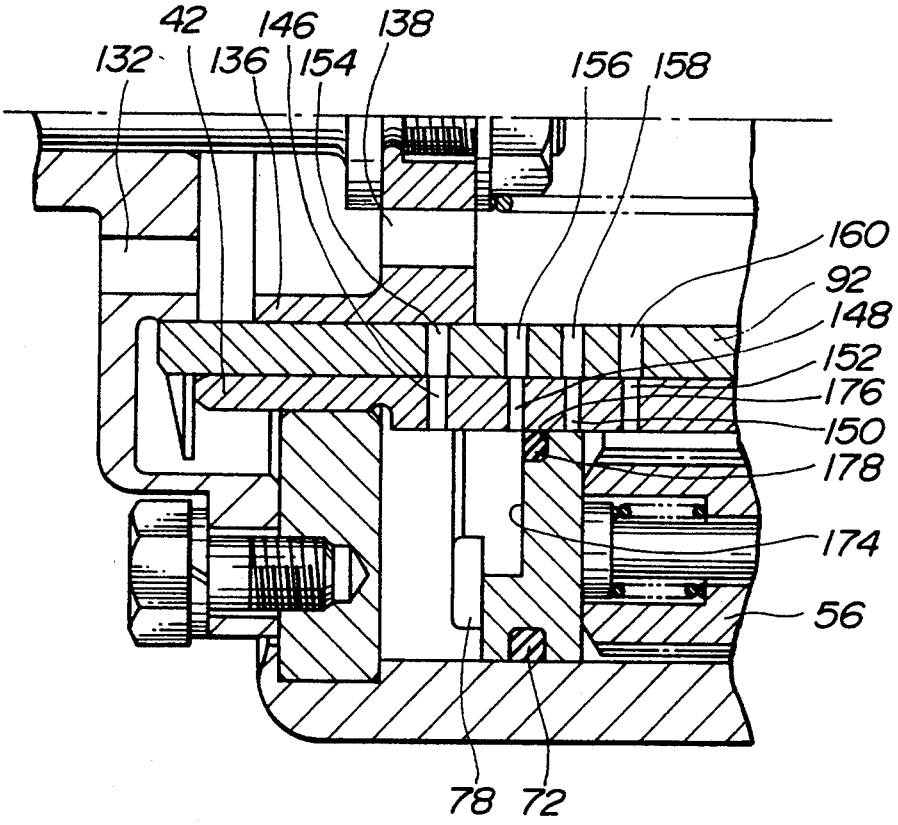
FIG. 12 is a fragmentary view of FIG. 1 illustrating a modified annular piston.
Figure 13:
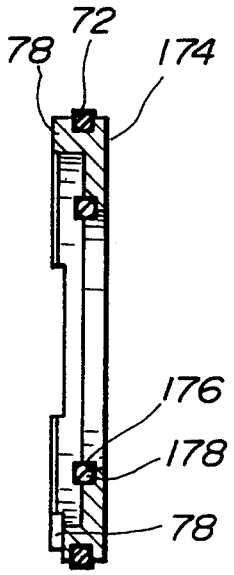
FIG. 13 is a similar view to FIG. 5 showing the modified piston.
Figure 14:
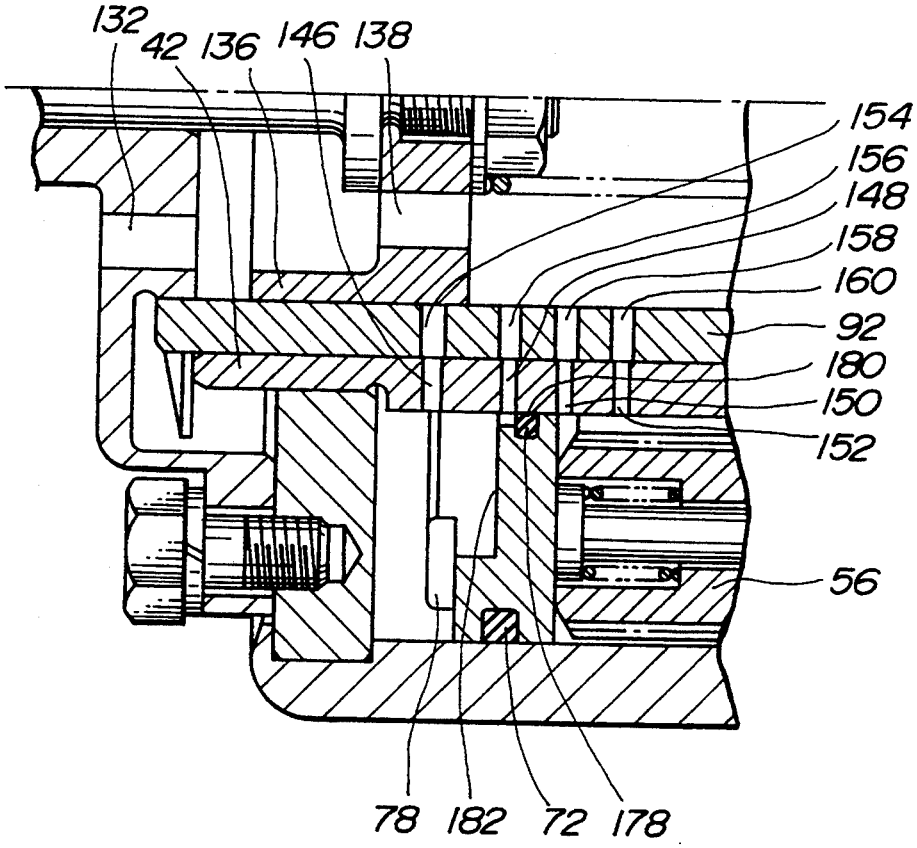
FIG. 14 is a similar view of FIG. 12 showing an altermative modification of annular piston.

FIGS. 12 and 13 show a modification to the annular piston 70. The modified annular piston 174 is formed with a cutout 176 at the outer or front edge of the inner peripheral wall thereof and has an annular seal 178 which slidably engages adjacent cylindrical wall of the stub shaft 42. In this case, the seal 178 functions to regulate flow of discharge oil from the annular chamber 76.

Although in the modification, the seal 178 located at the outer edge of the inner peripheral wall of the annular piston 174. The location of the seal is not limited to this example. The seal 178 may be recived in a groove 180 disposed between the outer and inner edges of the inner peripheral wall of the annular piston 182.

The provision of the seal 178 is found to be effective in holding the associated piston 174 or 182 in desired appropriate position during operation.

Figure 15:
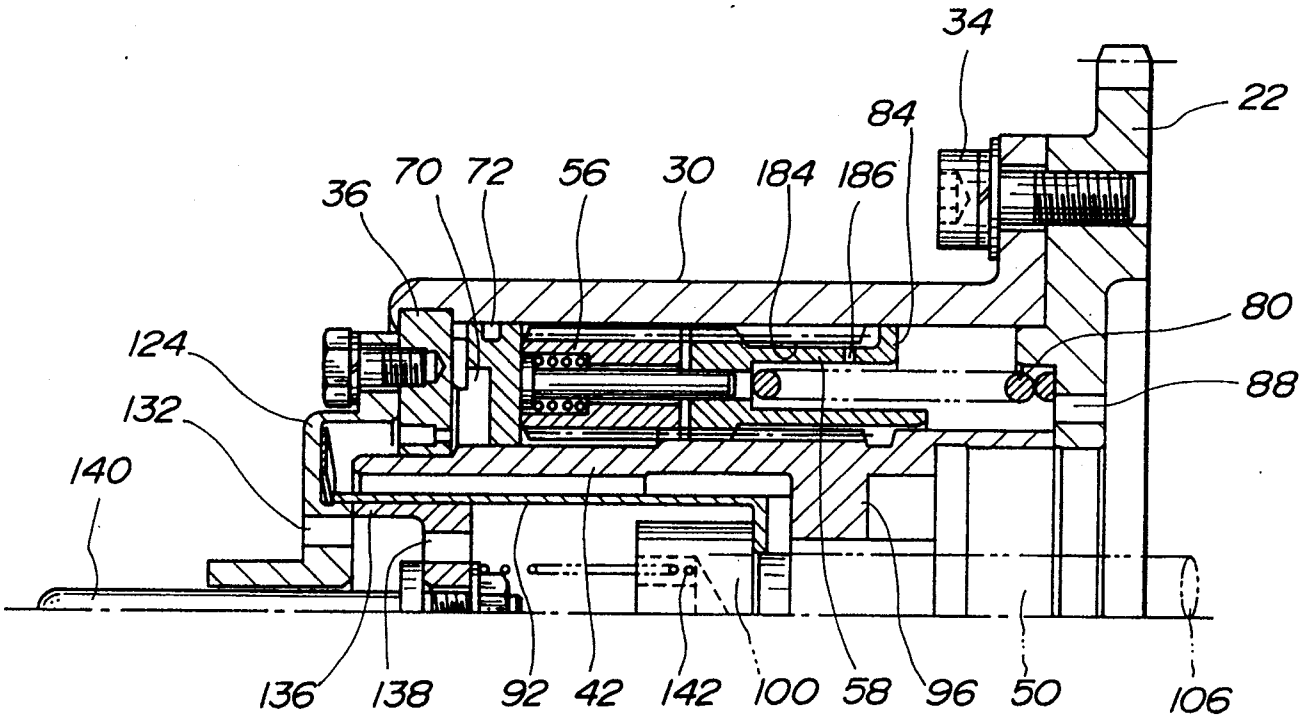
FIG. 15 is a fragmentary view of FIG. 1 showing a modified inner slide.

Referring to FIG. 15, it is now explained how pressure build-up due to the leaked oil. In operation, owing to centrifugal force the leaked oil is thrown outwardly against the external spline 40, causing pressurfe build-up within a space 184 partly defined by the protrusion 84. If this pressure is appliked to the protrusion 84, the inner slide 58 is urged toward the sprocket radially extending hub 26. This phanemena is not desired. Thus, the inner slide 58 has holes 186 connecting the space 184 to the recess 82 receiving the return spring 80.

Figure 16:
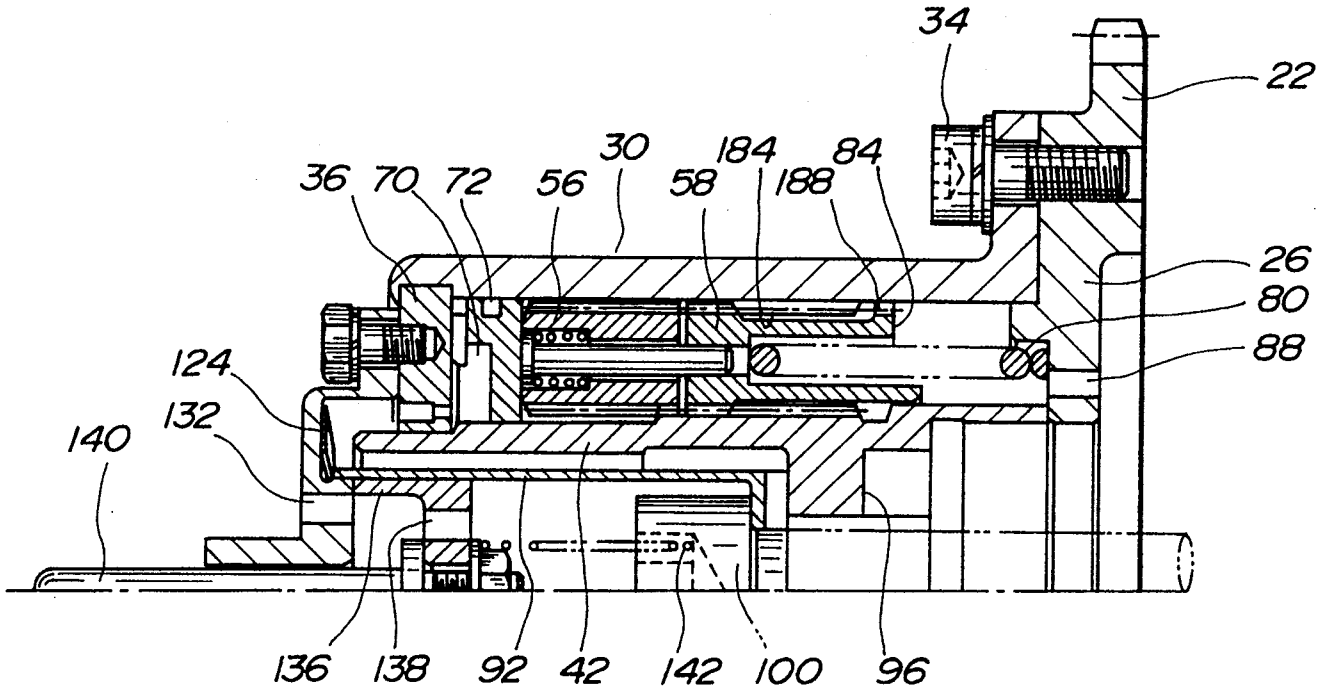
FIG. 16 is a similar view to FIG. 15 showing an alternative modification of inner slide.

FIG. 16 shows a variation to FIG. 15. According to this variation, the protrusion 84 has circumferentially spaced cutouts 188 to provide drain paths.

Figure 17:
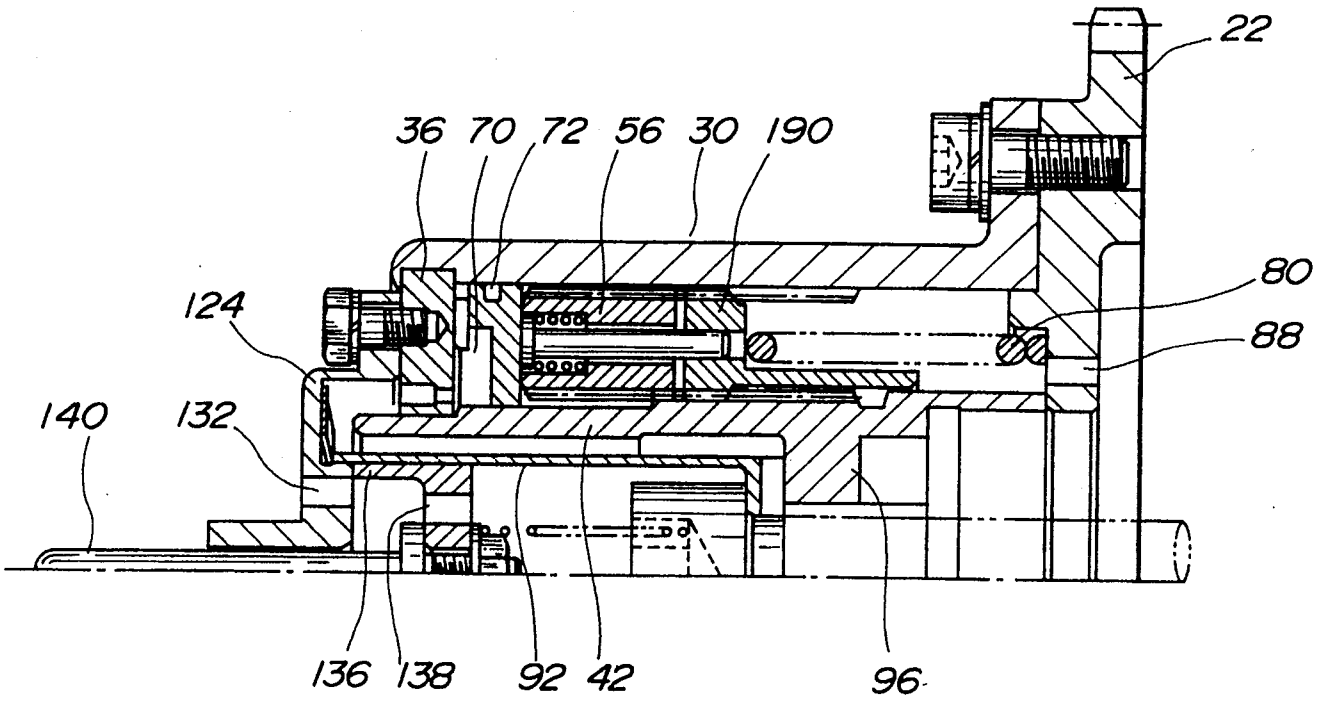
FIG. 17 is a similar view to FIG. 15 showing still another alternative of inner slide.

FIG. 17 shows another variation to FIG. 15. According to this variation, an inner slide 190 without such protrusion is proposed. This inner slide 190 is an alternative to the inner slide 58.

Figure 18:
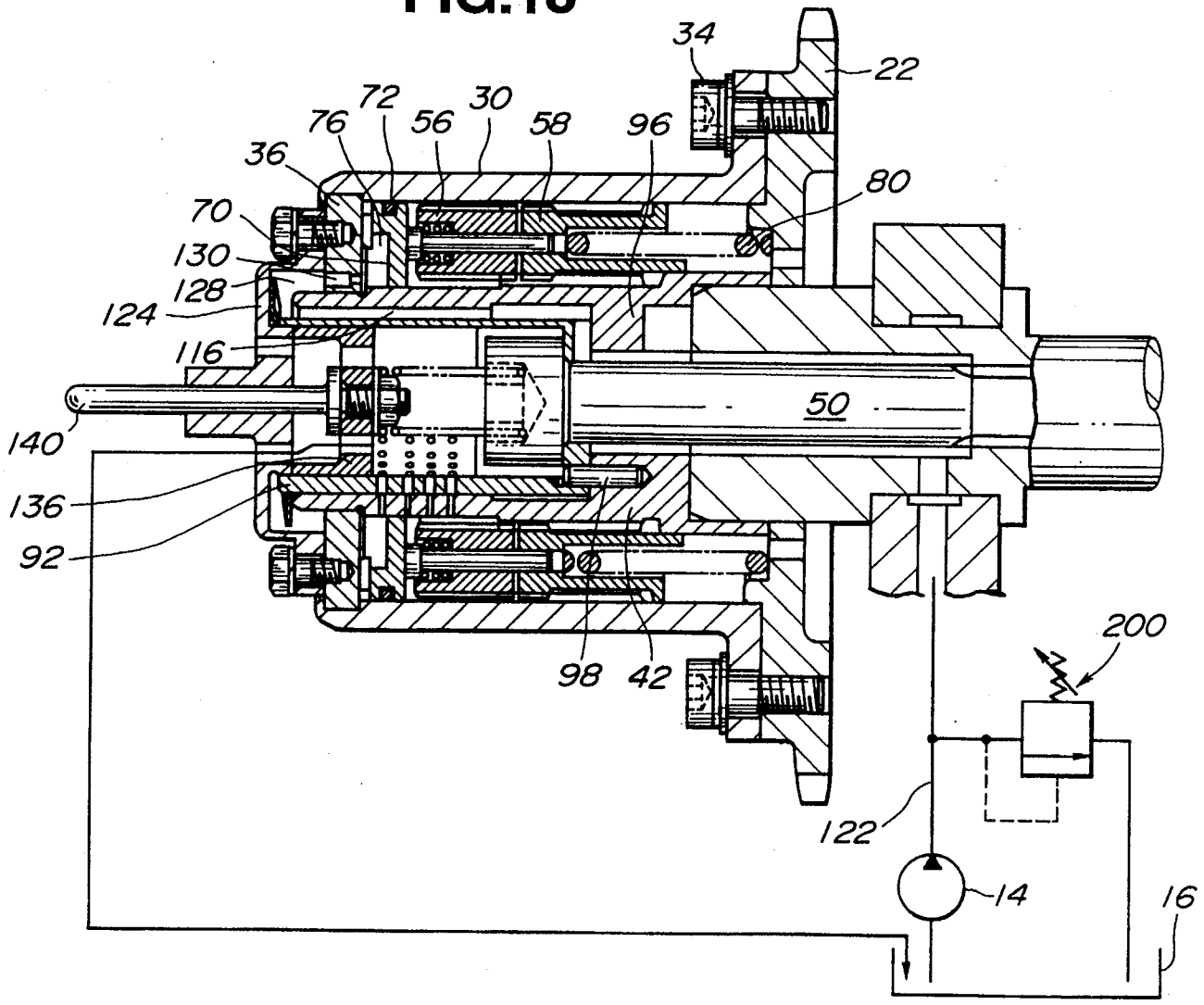
FIG. 18 is a similar view to FIG. 1 showing the detail of oil supply.
Figure 19:
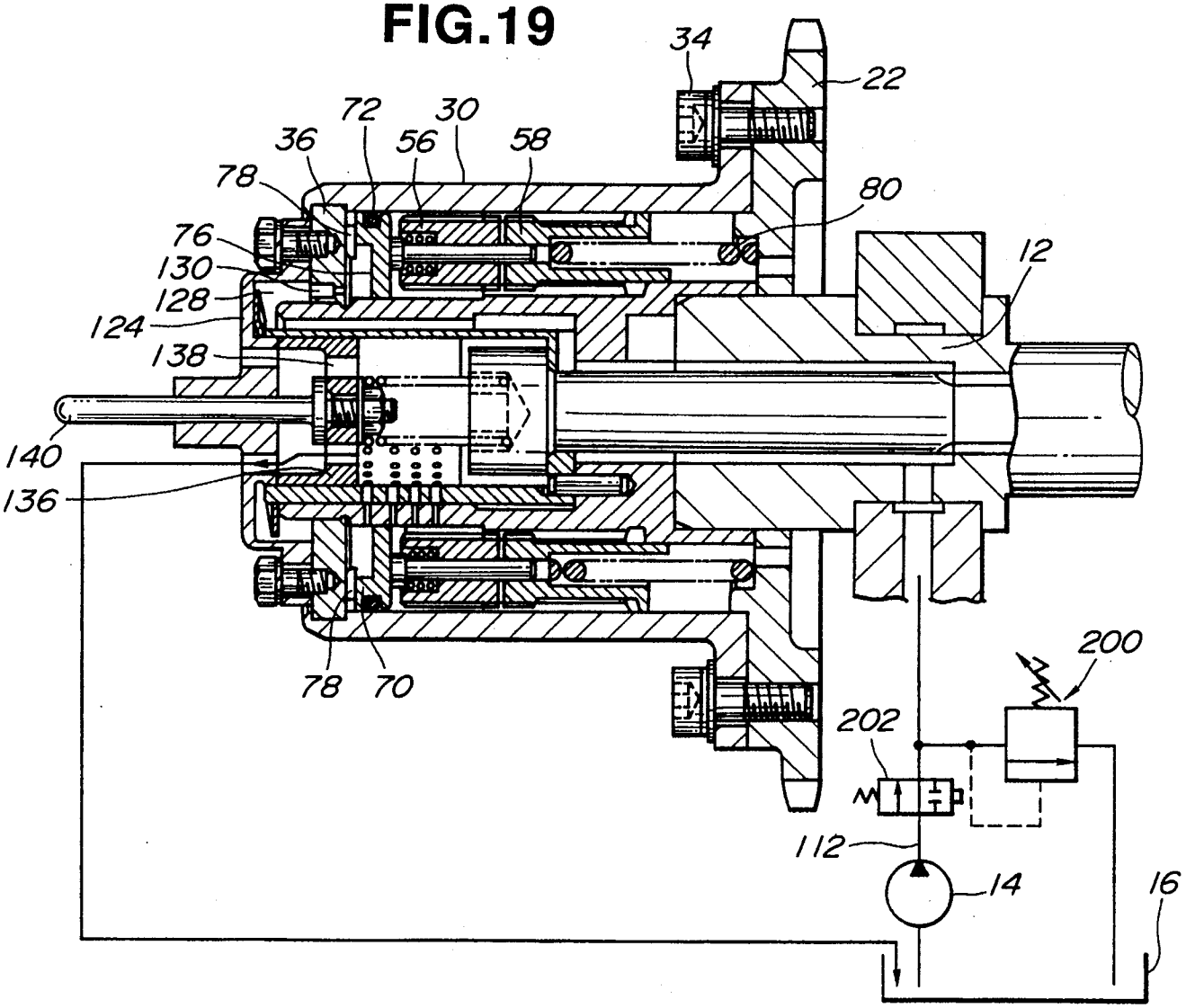
FIG. 19 is a similar view to FIG. 18 showing a modification of oil supply.

According to the VCP 18 previously described, oil is discharged outwardly from the drain holes 132 of the end plug 124. In order to reduce the amount of oil discharged out of the VCP 18, a relief valve 18 is provided to keep the pressure at which the oil is supplied to the VCP 18 from the oil gallery 112 at a level high enough to move the annular piston 70 as shown in FIG. 18. In order to further reduce the amount of oil discharged out of the VCP 18, there is provided a solenoid operated shut off valve 202 between the oil gallery 112 and relief valve 200. The solenoid operated shut off valve 202 blocks flow communication between the oil gallery 112 and VCP 18 when the engine operating condition calls for the most retarded valve timing and thus the VCP 18 is to take the position as illustrated in FIG. 1.

Oil resulting from regulation of pressure at the pressure relief valve 200 returns immediately to the oil pan 16 and there is no supply of oil from the oil gallery when the engine operating condiktions call for the most retarded valve timing. Thus, sufficient amount of oil is retained in the oil pan 16 and oil gallery 112 for distribution to portions to be lubricated.

Figure 20:
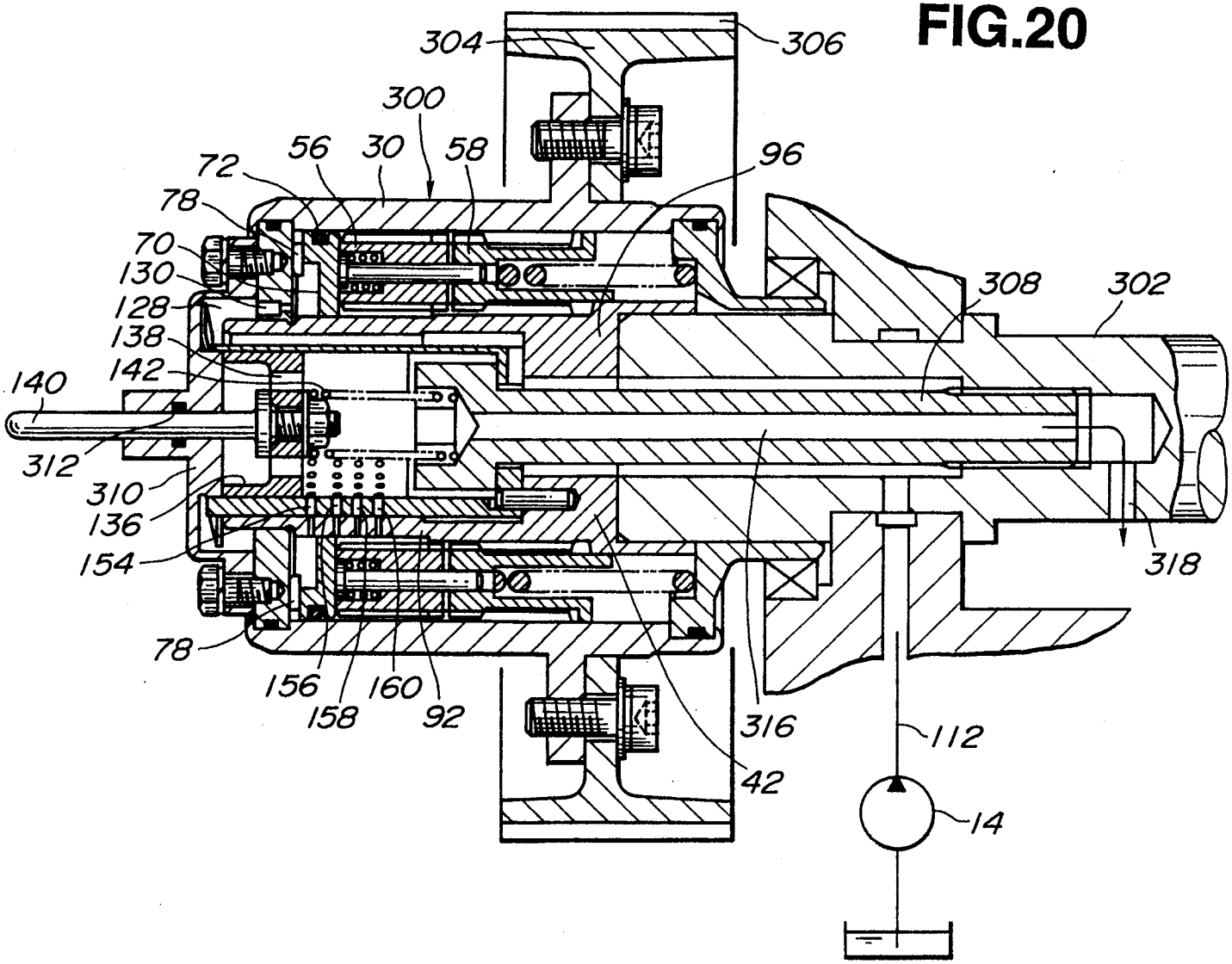
FIG. 20 is a similar view to FIG. 1 showing another embodiment.

FIG. 20 shows an embodiment of the invention for use with a timing belt drive.

A variable cam phaser (VCP) 300 is mounted on the front end of a camshaft 302. The VCP 300 includes a pulley 304 having an outer toothed wheel 306 driven by the timing belt, not shown. The wheel 306 is connected to a cylindrical body 30 in a similar manner to that shown in FIG. 1. A bolt 308 secures a bushing 92 and a srub shaft 42 to the camshaft 302 in a manner similar to that shown in FIG. 1. An end plug 310 is secured to a cover 36 in a manner similar to that shown in FIG. 1. In FIG. 20, the same reference numerals as used in FIG. 1 are used to designate like or similar parts or portions. Thus detailed description is thereby omitted.

The end plug 310 is different from the end plug 124 shown in FIG. 1. The end plug 310 carries an oil seal 312 for preventing oil leak through clearance around a rod 140 and has no drain holes (see drain holes 132 in FIG. 1). In order to discharge oil from a cylindrical bore 134 defined by the bushing 92, the bolt 308 has an axial through central bore 314 having one end opening to the cylindrical bore 134 and the opposite inner end opening to a central axial bore 316 of the camshaft 302. The camshaft 302 further has a radial drain passage 316 having an inner end opening to the axial bore 316 and an outer end opening to the inside of the engine casing. Owing to this path, oil discharged from the cylindrical bore 134 returns to an oil pan 16 through the axial bore 314 of the bolt 308, bore 316 of the camshaft 302 and radial passage 318.

Figure 21:
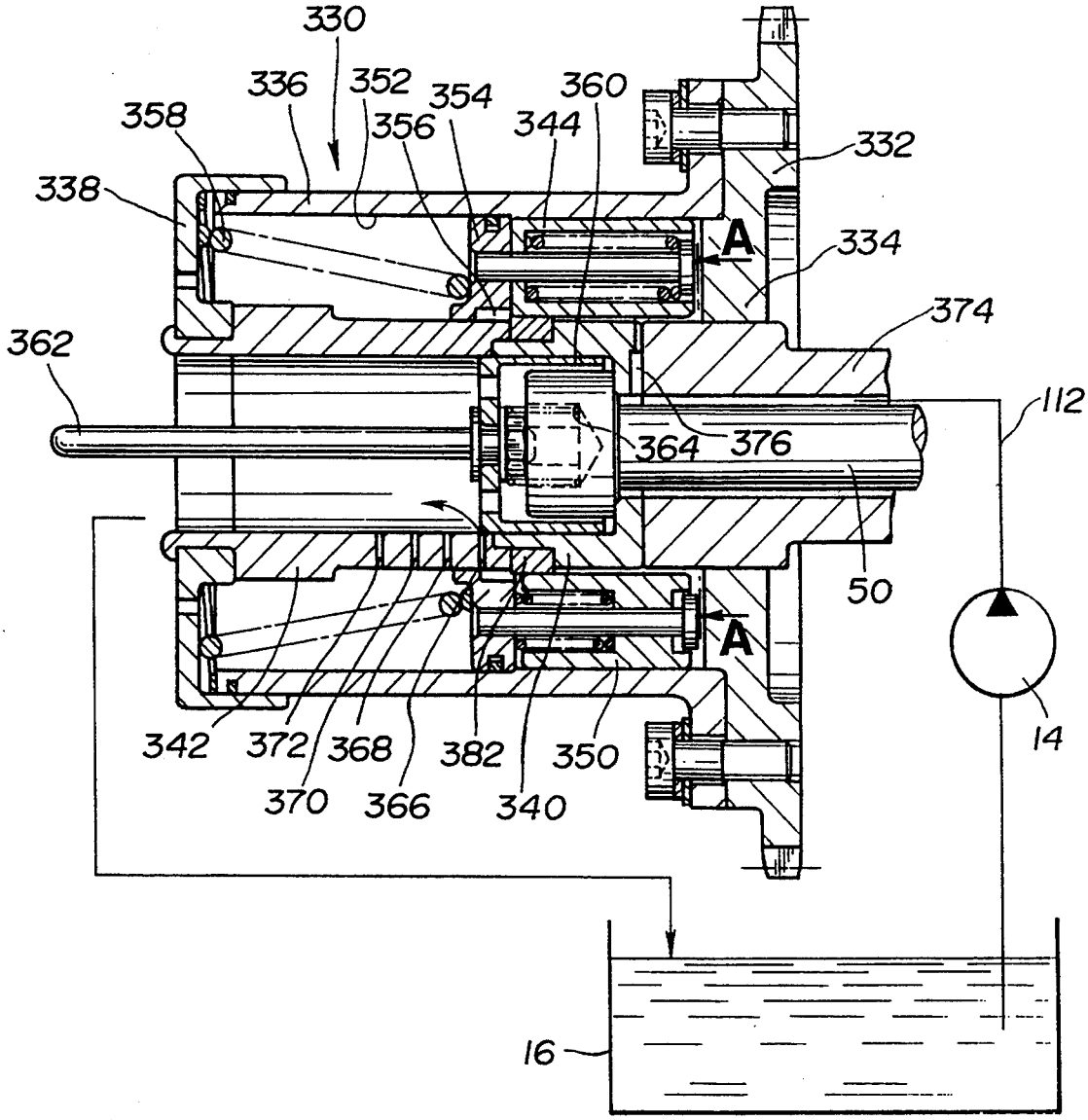
FIG. 21 is a similar view to FIG. 1 showing still another embodiment.
Figure 22:
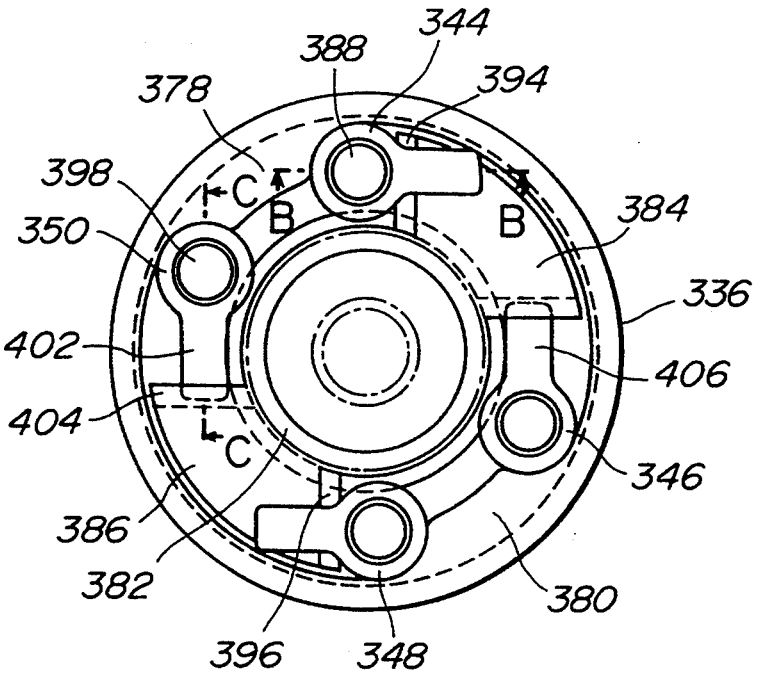
FIG. 22 is a section taken though the line A—A of FIG. 21.
Figure 25:
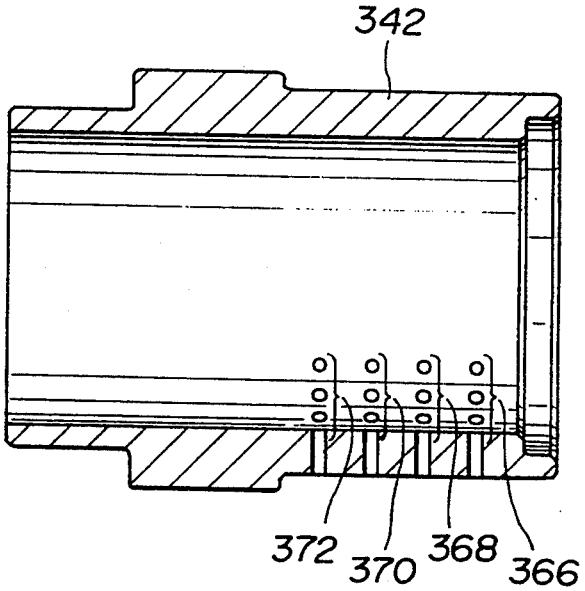
FIG. 25 is a longitudinal section of a cylindrical bushing.
Figure 26:
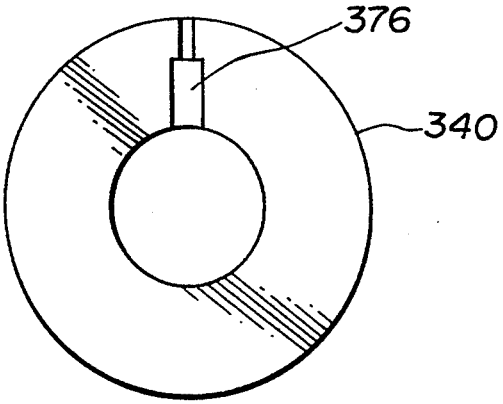
FIG. 26 is an end view of a stub shaft.
Figure 27:
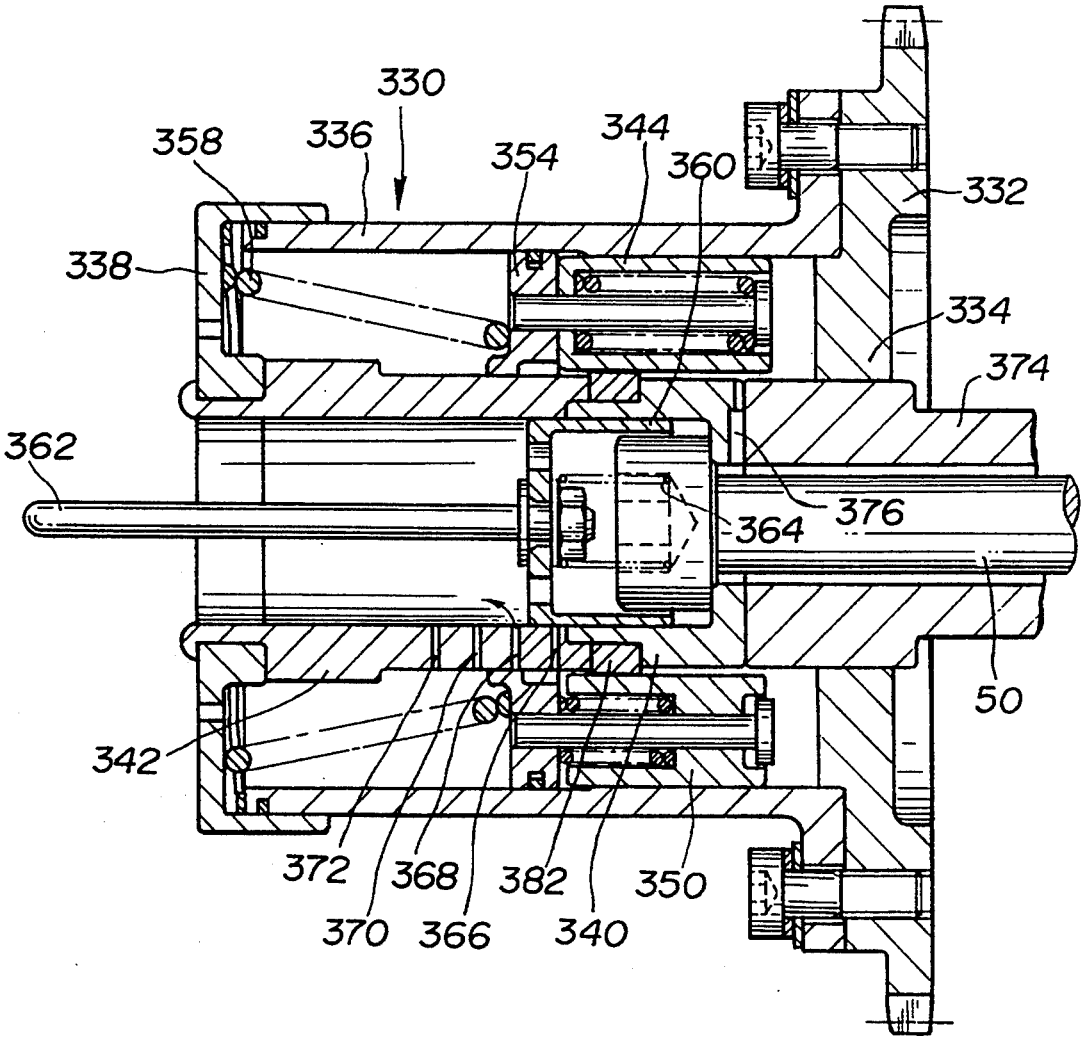
FIGS. 27, 28, 29 and 30 are views of corresponding to FIGS. 7, 8, 9 and 10, respectively.
Figure 28:
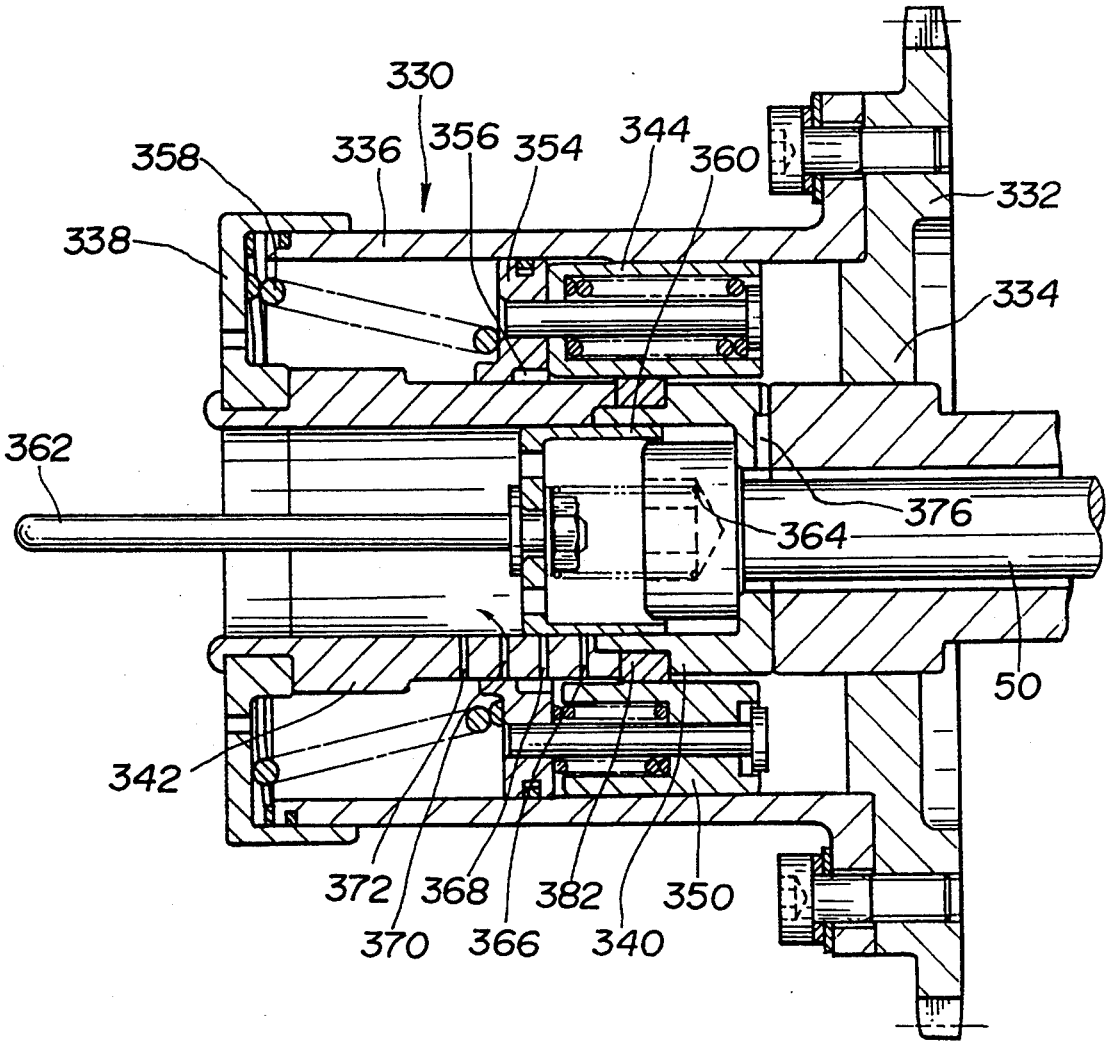
Figure 29:
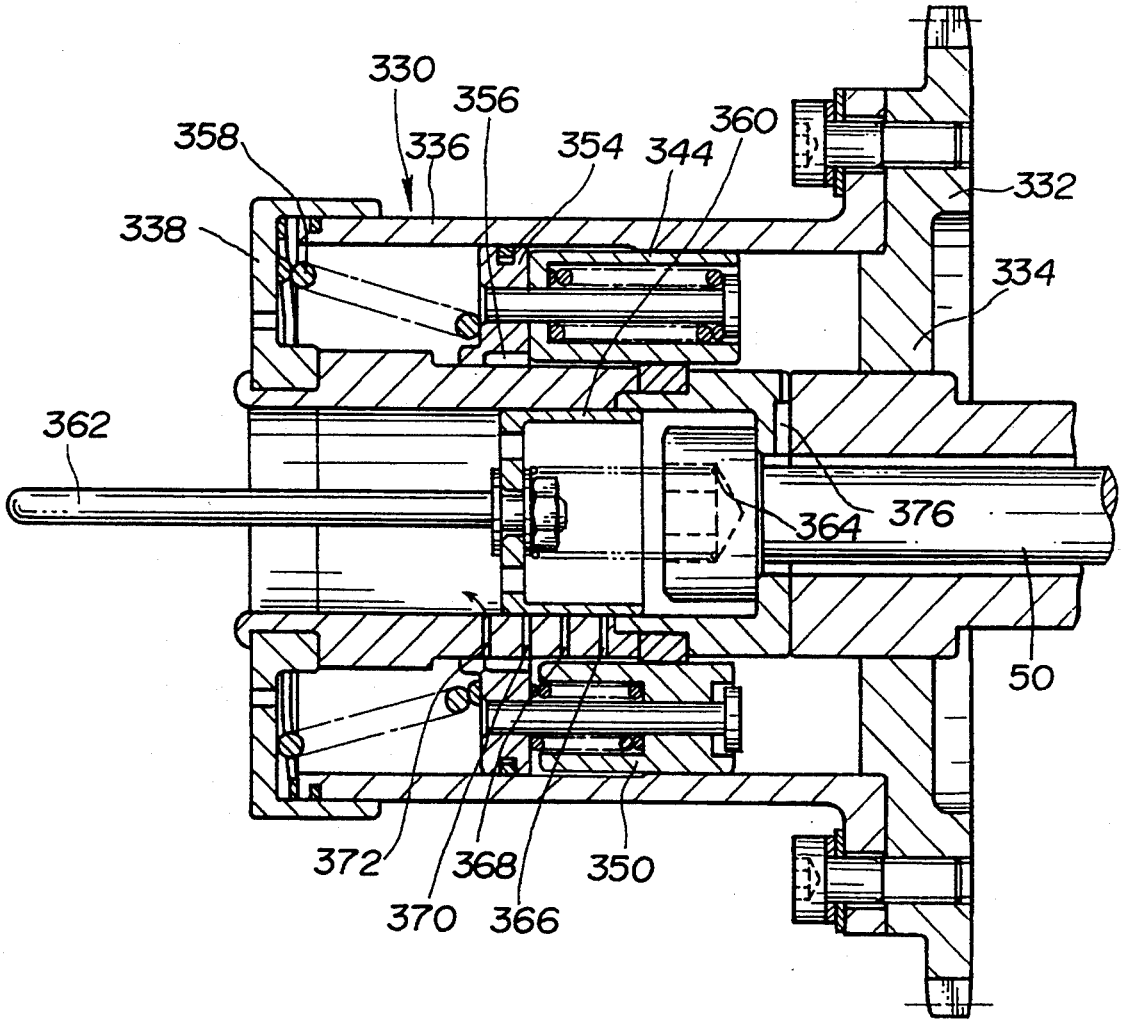
Figure 30:
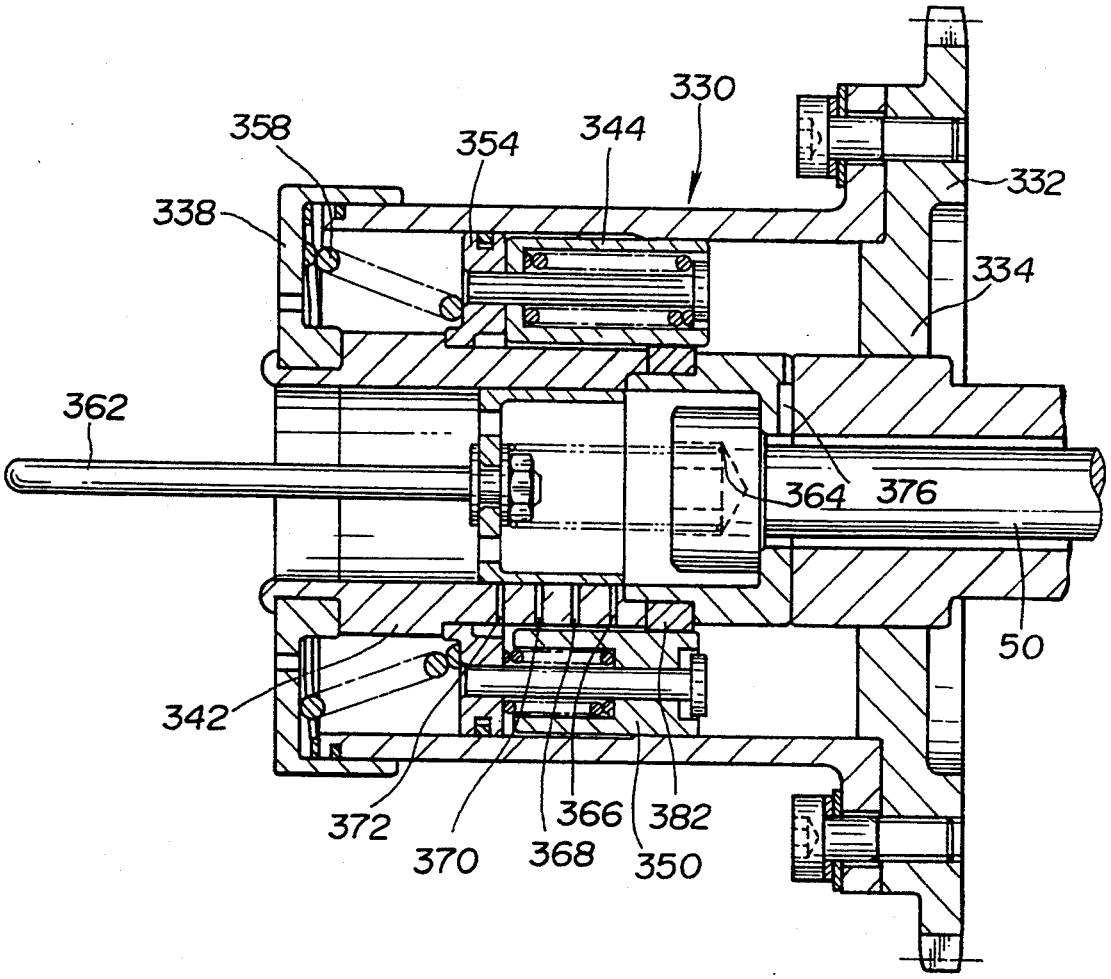

FIG. 21 shows another embodiment of VCP 330 which includes a sprocket 332 with a radially extending hub 334, a cylindrical body 336, a cover 338, a stub shaft 340, a cylindrical bushing 342, a bolt 344, four slides 344, 346, 348 & 350 (see also FIG. 22), an annular cylinder 352, an annular piston 354, an annular chamber 356, a return spring 358 for the piston 354, a valve slide 360 with a rod 362, and a return spring 364 for the valve slide 360 which, although slightly differing form, are the dunctional equivalents of the corresponding parts of the FIG. 1 embodiment. FIG. 12 differs in that the cylindrical bushing 342 has an end press fitted to the stub shaft 340 and fixedly retains at a front end the cover 338. The cover 338 rotatably receives an outer end the cylindrical body 336. As best seen in FIG. 25, the bushing 342 has four outlets 366, 368, 370 and 372 which function alo as valve ports and thus are functional equivalents to the outlets 146, 148, 150, 152 and their associated valve ports 154, 156, 158 and 160, respectively. The stub shaft 340 cooperates with the front end of the associated camshaft 374 to define an inlet orifice 376 which is always open to the annular chamber 356. Supply of oil to this inlet orifice 376 is schematically illustrated.

As different from FIG. 1 embodiment, the cylindrical body 336 and the stub shaft 340 have no helical splines.

Figure 23:
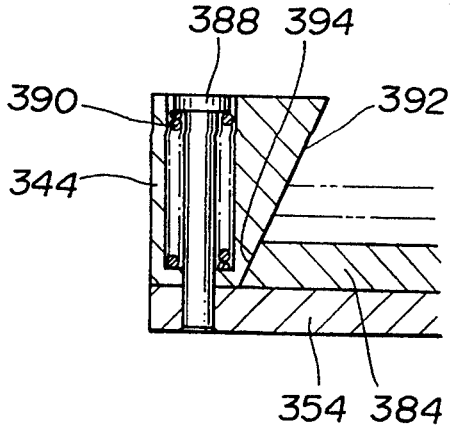
FIG. 23 is a section taken through the line B—B of FIG. 22.
Figure 24:
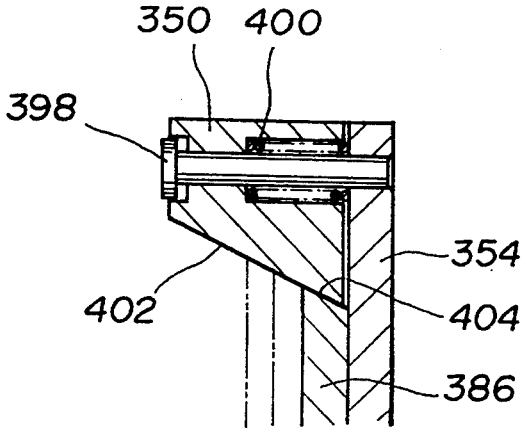
FIG. 24 is a secion taken through the line C—C of FIG. 22.

In FIG. 21 embodiment, the cylindrical body 336 has diameterically opposed inwardly extending guides 378 and 380, the stub shaft 340 is fixedly coupled with a ring 382 with two diameterically opposed radially extending hubs 384 and 386. The radially extending hub 384 is disposed between the guides 378 and 380, while the other radially extending hub 386 is disposed between the guides 380 and 378. The slide 344 is disposed between and drivingly mated with the guide 378 and the radially extending hub 384. The slide 346 is disposed between and drivingly mated with the radially extending hub 384 and guide 380. The slide 348 is disposed between and drivingly mated with the guide 380 and radially extending hub 386. The slide 350 is disposed between and drivingly masted with the radially extending hub 386 and guide 378. As best seen in FIG. 23, the slide 344 is mounted to the annular piston 354 by a pin 388 and resiliently biased against the annular piston 354 by a spring 390. The slide 344 has an inlined surface 392 drivingly mated with an inclined edge 394 of the radially extending hub 384. In a similar manner to the slide 344, the slide 348 is mounted to the annular piston 354 by a pin, not shown, and resiliently biased against the annular piston 354 by a spring, not shown, and has an inclined surface drivingly mated with an inclined edge of the radially extending hub 386. As best seen in FIG. 24, the slide 350 is mounted to the annular piston 354 by a pin 398 and resiliently biased against the annular piston 354 by a spring 400. The slide 350 has an inlined surface 402 drivingly mated with an inclined edge 404 of the radially extending hub 386. In a similar manner to the slide 350, the slide 346 is mounted to the annular piston 354 by a pin, not shown, and resiliently biased against the annular piston 354 by a spring, not shown, and has an inclined surface 406 drivingly mated with an inclined edge 408 of the radially extending hub 384.

As will be readily understood from FIGS. 21, 22, 23 and 24, axial movement of the annular piston 354 imparts torque to the stub shaft 340 via the radially extending hubs 384 and 386 of the ring 382 and thus changes the phase angle of the camshaft 374 relative to the sprocket 332.

In addition to the phase-changing function, the slides 344, 346, 348 and 350 are also the measn through which all torque is transferred from the sprocket 332 to the camshaft 374 and vice versa.

The VCP 330 has five positions as illustrated in FIGS. 21, 27, 28, 29 and 30 which, although slightly differeing form, correspond to the operative positions of FIG. 1 embodiment as illustrated in FIGS. 1, 7, 8, 9 and 10.

What is claimed is:

1. A variable cam phaser comprising drive and driven members, coupling means for drivingly connecting said drive and driven members in driving relation, said coupling means including means for enabling said drive and driven members to be relatively angularly adjustable while maintaining the driving relation therebetween, said enabling means including a hydraulic cylinder, a piston slidably mounted for movement in said hydraulic cylinder, said piston defining in said cylinder a fluid chamber, and a return spring biasing said piston toward said fluid chamber, the movement of said piston in said cylinder causing said drive and driven members to undergo relative angular displacement in a direction corresponding to the direction of movement of said piston, and valve means for pressurizing said fluid chamber for displacing said piston in one direction against said return spring and depressurizing said fluid chamber for allowing said return spring to displace said piston in the opposite direction and thereby controlling the relative angular position of said drive and driven members, wherein there are provided an inlet which is always open to said fluid chamber and a plurality of outlets for venting said cylinder, said plurality of outlets including a first outlet which is always open to said fluid chamber and at least one second outlet for venting said hydraulic cylinder, said valve means has a first end position wherein said first outlet is vented to depressurize said fluid chamber, allowing said piston to take one extreme position thereof under the bias of said return spring, said piston in said one extreme position thereof blocking flow communication between said fluid chamber and said second outlet, said valve means has a second end position wherein said first and second outlets are closed to pressurize said fluid chamber, displacing said piston against said return spring to the opposite extreme position thereof, said piston in said opposite extreme position thereof opening flow communication between said fluid chamber and said second outlet, said valve means has an intermediate position wherein said first outlet is closed and said second outlet is vented, moving said valve means from said first end position thereof to said intermediate position thereof pressurizes said fluid chamber, displacing said piston against said return spring until said piston regulates discharge of hydraulic fluid from said fluid chamber through said second outlet to establish an equilibrium state wherein pressure within said fluid chamber balances with said return spring, moving said valve means from said second end position thereof to said intermediate position thereof depressurizes said fluid chamber, allowing said return spring to displace said piston until said piston regulates discharge of hydraulic fluid from said fluid chamber through said second outlet to establish said equilibrium state.

2. A variable cam phaser as claimed in claim 1, wherein said coupling means includes a stub shaft secured to said driven member, radially extending hubs extending radially outwardly from said stub shaft, slides drivingly mated with said radially extending hubs and drivingly connected with said piston for movement therewith, and means whereby movement of said slider with said piston causes angular displacement of said radially extending hubs and said stub shaft, thereby to change phase angle of said driven member relative to said drive member.

3. A variable cam phaser as claimed in claim 1, wherein said coupling means includes a cylindrical body which is secured to said drive member and has internal spline, a stub shaft which is adapted to be secured to said driven member and has external spline, and splined slide means mated with said internal and external splines.

4. A variable cam phaser as claimed in claim 3, wherein said splined slide means includes two splined slides resiliently biased toward each other.

5. A variable cam phaser as claimed in claim 4, wherein one of said splined slides has a protrusion slidably engaging with the adjacent wall to serve as a guide of movement of said splined slides.

6. A variable cam phaser as claimed in claim 5, wherein said one splined slide has drain holes adjacent said protrusion.

7. A variable cam phaser as claimed in claim 5, wherein said one splined slide has cutouts at said protrusion.

8. A variable cam phaser as claimed in claim 4, wherein one of said splined slides is not provided with a protrusion slidably engaging with the adjacent wall to serve as a guide of movement of said splined slides.

9. A variable cam phaser as claimed in claim 1, wherein said valve means includes a valve slide slidable to close said second outlet.

10. A variable cam phaser as claimed in claim 9, wherein said second outlet communicates with the associated valve port, and said valve slide is movable to cover said valve port.

11. A variable cam phaser as claimed in claim 10, wherein the size of said second outlet is smaller than the size of the associated valve port.

12. A variable cam phaser as claimed in claim 10, wherein said first outlet is dimension such that flow of oil discharged from said fluid chamber is high enough to hold pressure in said fluid chamber sufficiently below a pressure which balances with said return spring.

13. A variable cam phaser as claimed in claim 1, wherein each of said plurality of outlets is constituted by a circumerentially extending slit.

14. A variable cam phaser as claimed in claim 1, wherein said piston has a seal serving as a valve element.

15. A variable cam phaser as claimed in claim 1, wherein said coupling means includes a stub shaft secured to said driven member by a bolt, said bolt has an axial bore therethrough serving as a discharge passage.

16. A variable cam phaser as claimed in claim 1, wherein a relief valve is provided to keep pressure at which hydraulic fluid is supplied to said inlet at or below a predetermined pressure.

17. A variable cam phaser as claimed in claim 16, wherein a shut off valve is provided to block fluid communication between said inlet and a source of fluid pressure.

* * * * *